US009517423B1

(12) United States Patent
Kanbar et al.

(10) Patent No.: US 9,517,423 B1
(45) Date of Patent: Dec. 13, 2016

(54) TOY CONSTRUCTION SET

(71) Applicants: Maurice S. Kanbar, San Francisco, CA (US); Albert Kolvites, San Mateo, CA (US)

(72) Inventors: Maurice S. Kanbar, San Francisco, CA (US); Albert Kolvites, San Mateo, CA (US)

(73) Assignee: Maurice S. Kanbar Revocable Trust, San Francisco, CA (US)

( * ) Notice: Subject to any disclaimer, the term of this patent is extended or adjusted under 35 U.S.C. 154(b) by 0 days.

(21) Appl. No.: 14/180,211

(22) Filed: Feb. 13, 2014

(51) Int. Cl.
*A63H 33/08* (2006.01)

(52) U.S. Cl.
CPC ..... *A63H 33/088* (2013.01)

(58) Field of Classification Search
CPC ..... A63H 33/042; A63H 33/08; A63H 33/04; A63F 9/06
USPC ..... 446/112, 118, 124, 126
See application file for complete search history.

(56) References Cited

U.S. PATENT DOCUMENTS 1,894,061 A * 1/1933 Sanders ..... A63H 33/084 446/114
3,748,752 A * 7/1973 Quercetti ..... A63F 9/06 434/96
3,819,188 A * 6/1974 Freedman ..... 273/160
3,961,439 A * 6/1976 Moustakas ..... A63H 3/16 273/153 R
3,965,610 A 6/1976 Ouden
4,164,091 A * 8/1979 Lin ..... 446/118
4,253,268 A 3/1981 Mayr
4,458,441 A 7/1984 Bril
4,547,160 A 10/1985 Labelle
4,722,537 A * 2/1988 Chau-Pin ..... 280/1.13
4,813,903 A 3/1989 Furukawa et al.
4,861,211 A * 8/1989 Dunsmore ..... 411/501
D308,234 S * 5/1990 Fish, Jr. ..... D21/490
D314,995 S 2/1991 Poulsen et al.
4,998,903 A 3/1991 Bolli et al.
5,073,138 A 12/1991 Klitsner et al.
D330,052 S 10/1992 Klitsner
5,194,031 A 3/1993 Sahler
5,259,803 A 11/1993 Lyman
(Continued)

*Primary Examiner* — Vishu Mendiratta
(74) *Attorney, Agent, or Firm* — Litts Law Firm

(57) ABSTRACT

A toy construction set comprises a base block and one or more rotating blocks configured for coupling to the base block, to other rotating blocks, or to both. The base block may be define by an upper surface, a lower surface, and at least one side surface. The base block may comprise a body and a plurality of projections extending outward from the body. Interior cylindrical surfaces may extend between the upper surface and the lower surface of the base block. An upper chamfer may connect the interior cylindrical surface with the upper surface, and a lower chamfer may connect the interior cylindrical surface with the lower surface. The rotating blocks may comprise a hub having a body and a grip extending upward from the upper end of the body. Optionally, the hub may also have a coupling mechanism extending downward from the lower end of the body. Structural elements may emanate from the body of the hub. In various embodiments, the structural elements may comprise a spur gear body, a picture holder support body, a fold-up toy support body, a drive wheel support body, or a driven wheel support body.

11 Claims, 21 Drawing Sheets

(56) References Cited

U.S. PATENT DOCUMENTS

| | | | | |
|---|---|---|---|---|
| 5,453,034 | A | 9/1995 | Larws | |
| D364,199 | S | 11/1995 | Schmidt et al. | |
| D366,073 | S | 1/1996 | Schmidt et al. | |
| D388,475 | S | 12/1997 | Glickman | |
| 5,759,081 | A | 6/1998 | Lyman | |
| 5,779,515 | A * | 7/1998 | Chung | 446/90 |
| 6,315,628 | B1 * | 11/2001 | Quercetti | 446/128 |
| D456,462 | S | 4/2002 | Sorensen | |
| 6,443,795 | B1 | 9/2002 | Lin | |
| 6,443,796 | B1 | 9/2002 | Shackelford | |
| 6,461,215 | B1 | 10/2002 | Kunz et al. | |
| D469,821 | S | 2/2003 | Manville | |
| D472,941 | S | 4/2003 | Manville | |
| 6,585,553 | B1 | 7/2003 | Fetridge et al. | |
| 6,736,691 | B1 * | 5/2004 | Bach | 446/128 |
| 6,761,563 | B1 * | 7/2004 | Lin | 434/169 |
| 6,773,323 | B1 | 8/2004 | Huang | |
| 6,821,182 | B2 | 11/2004 | Polick | |
| D550,783 | S | 9/2007 | Glickman | |
| 7,666,054 | B2 * | 2/2010 | Glickman et al. | 446/124 |
| 7,736,211 | B2 * | 6/2010 | Marzetta | 446/122 |
| 7,797,890 | B2 * | 9/2010 | Thrush | E04F 15/10 446/116 |
| 2002/0065016 | A1 | 5/2002 | Huang | |
| 2005/0272301 | A1 * | 12/2005 | Bruder | 439/409 |
| 2007/0281579 | A1 * | 12/2007 | Sambenedetto | 446/124 |
| 2008/0228450 | A1 | 9/2008 | Jakobsen et al. | |
| 2009/0305602 | A1 | 12/2009 | Gaute | |
| 2010/0241403 | A1 | 9/2010 | Jakobsen et al. | |
| 2012/0309260 | A1 | 12/2012 | Coon | |
| 2013/0217296 | A1 * | 8/2013 | Widjaja | A63H 33/101 446/124 |

* cited by examiner

TOY CONSTRUCTION SET

TECHNICAL FIELD

The present invention relates to toy construction sets, and more particularly to a toy construction set comprising a base block and one or more rotating blocks.

BACKGROUND

Toy construction sets provide an enjoyable and stimulating play experience that can develop spatial skills and creativity in children. Traditional toy construction sets include base blocks of one or more types that can be assembled to create a variety of structures. The educational value of a toy construction set is enhanced if more complex components, in addition to base blocks, are included. For example, some toy construction sets include gears that can be coupled to base blocks or to other structural components. One such toy construction set is disclosed in U.S. Pat. No. 6,315,628, to Quercetti. Quercetti discloses a composable base plate having a matrix of coupling bores. Quercetti also describes a complex element that is configured for coupling to the base block via a special element and a series of tubular and flanged elements, referred to by Quercetti as elements of the first and second kinds, respectively. The special element is described as having four pins protruding from its bottom surface for engaging the coupling bores in the base plate. Each complex element has at least one axle that can be received into a connection bore formed in a toothed wheel. While the toy construction set disclosed by Quercetti provides for the construction of relatively complex structures compared to construction sets that include only base blocks, it suffers from several disadvantages. In particular, some of the elements disclosed by Quercetti are relatively small and may present a choking hazard to small children. Furthermore, the toothed wheels of Quercetti cannot be attached directly to a base block, and also cannot be coupled to other toothed wheels. Therefore, the variety of structures that can be built with the components disclosed by Quercetti is limited. Accordingly, an improved toy construction set is needed.

SUMMARY

One embodiment of the present invention is directed to a base block for use in a toy construction set comprising an upper surface, a lower surface, and at least one side surface extending between the upper surface and the lower surface. An interior cylindrical surface may extend between the upper surface and the lower surface. An upper chamfer may connect the interior cylindrical surface to the upper surface, and a lower chamfer may connect the interior cylindrical surface to the lower surface. The base block may be formed of an upper base block portion and a lower base block portion. The upper base block portion may comprise an upper wall, at least one side wall, and at least one upper column portion. The lower base block portion may comprise a lower wall and at least one lower column portion. The upper base block portion and the lower base block portion may be configured to be coupled to each other, and the upper column portion and the lower column portion may be configured to mesh with each other to form a hollow cylindrical column when the upper base block portion and the lower base block portion are coupled to each other. An upper radius or an upper chamfer may connect at least one side surface to the upper surface, and a lower radius or a lower chamfer may connect at least one side surface to the lower surface.

The base block may comprise a body and a plurality of projections extending outward from the body. The body may be formed in the shape of a rectangular cuboid. Interior cylindrical surfaces may extending between the upper surface and the lower surface of the body in a quincunx pattern. At least one of the projections may be a cube-shaped projection, and at least one of the projections may be a square cuboid-shaped projection that is approximately twice the size of the cube-shaped projection. Exactly one interior cylindrical surface may extending through the cube-shaped projection, and exactly two interior cylindrical surfaces may extend through the square cuboid-shaped projection.

At least one ridge may be formed along at least a portion of the length of an outermost vertical edge of at least one of the projections, and at least one notch may be formed along at least a portion of the length of an innermost vertical edge of at least one of the projections. The vertical ridge formed along the base block may be configured to engage with a notch formed along at least a portion of an innermost vertical edge of a projection formed on a second base block when the base block and the second base block are coupled to each other in a planar configuration. The notch formed along the base block may be configured to engage with a vertical ridge formed along at least a portion of an outermost vertical edge of a projection formed on the second base block when the base block and the second base block are coupled to each other in a planar configuration. The vertical ridge formed along the base block may also be configured to engage with a radius or a chamfer connecting a side surface to an upper surface or a lower surface of the second base block when the base block and the second base block are coupled to each other in an orthogonal configuration.

Another embodiment of the present invention is directed to a rotating block for use in a toy construction set comprising a hub comprising a body having an upper end and a lower end, and a grip extending upward from the upper end of the body. At least one structural element may emanate from the body of the hub. A hole may be formed downward from the upper end of the hub through at least a portion of the length of its axis. The hole may be configured to receive a coupling mechanism extending downward from the lower end of a body of a hub of a second rotating block. The hole may define an interior cylindrical surface, and a notch may be formed in the interior cylindrical surface. The notch may be configured to receive a projection formed on an exterior side surface of the coupling mechanism of the second rotating block at its lower end. A key may be formed on the interior cylindrical surface at least partially across the hole. The key may be configured to engage a slot formed in the coupling mechanism of the second rotating block at its lower end. A plurality of ridges may formed at approximately regular intervals around the exterior side surface of the grip. The diameter of the ridges may progressively increase from the upper-most ridge to the lower-most ridge.

The hub may further comprise a coupling mechanism extending downward from the lower end of the body. The coupling mechanism may be configured to be received into a hole formed downward from a top surface of a hub of a second rotating block through at least a portion of the length of its axis. The coupling mechanism may also be configured to be received into an interior cylindrical surface extending between an upper surface and a lower surface of a base block. The coupling mechanism may comprise a cylindrical column that is slotted at its lower end to form first and second resilient legs, a first projection formed on an exterior side surface of the first resilient leg at its lower end, and a second projection formed on an exterior side surface of the second resilient leg at its lower end. A hole may be formed upward from the lower end of the cylindrical column through at least a portion of the length of its axis. The first projection and the second projection may be configured to engage an upper chamfer connecting an interior cylindrical surface to an upper surface of a base block, and the first projection and the second projection may be configured to engage a lower chamfer connecting an interior cylindrical surface to a lower surface of the base block. The first projection and the second projection may also be configured to be received into a notch that is formed in an interior cylindrical surface defined by a hole formed downward from the upper end of a hub of a second rotating block through at least a portion of the length of its axis.

In another embodiment of the rotating block, a hole may be formed upward from the lower end of the body through at least a portion of the length of its axis. The hole may be configured to receive a grip extending upward from an upper end of a body of a hub of a second rotating block. The hole may define an interior side surface that is tapered. The interior side surface may have a diameter that is greatest at its lower end and that decreases linearly upwards through the body. Alternatively, the hole may define an interior side surface that is cylindrical.

In one embodiment of the rotating block, the at least one structural element may comprise a spur gear body having a perimeter that is shaped so as to define a plurality of teeth. A side wall may extend downward from the perimeter of the spur gear body. The side wall may a curvature that matches the shape of the perimeter of the spur gear body. At least one gusset panel may be formed along the lower surface of the spur gear body and may be coupled to the the body of the hub.

In another embodiment of the rotating block, the at least one structural element may comprise a picture holder support body and at least one slotted picture holder coupled to a distal end of the picture holder support body. The picture holder support body may have a perimeter that is shaped so as to define a plurality of support projections. One slotted picture holder may be coupled to a distal end of each of the support projections. At least one gusset panel may be formed along the lower surface of the picture holder support body and may be coupled to the body of the hub. The slotted picture holder may comprise a first picture holder arm, a second picture holder arm, and a picture holder base. The first and second picture holder arms may be coupled at their lower ends to the picture holder base, thereby defining a slot between the first and the second picture holder arms and above the picture holder base. The slotted picture holder may further comprise at least one ridge formed vertically along an interior side surface of the first picture holder arm, and at least one ridge formed vertically along an interior side surface of the second picture holder arm.

In another embodiment of the rotating block, the at least one structural element may comprise a fold-up toy support body. A plurality of slots may be formed downward from the top surface of the fold-up toy support through at least a portion of its height. The fold-up toy support body may have a perimeter that is shaped so as to define a circle. A plurality of projections may be formed on the lower surface of the fold-up toy support body, and the slots may be formed downward through the entire height of the fold-up toy support body and at least a portion of the height of the projections. At least one ridge may be formed vertically along each interior side surface defined by the slots. A side wall may extend downward from the perimeter of the fold-up toy support. The side wall may have a curvature that matches the shape of the perimeter of the fold-up toy support body and a lower edge that is shaped so as to define a plurality of teeth. At least one gusset panel may be formed along the lower surface of the fold-up to support body and may be coupled to the side wall. A fold-up toy may have a plurality of lower tabs configured to be received into the slots.

In another embodiment of the rotating block, the at least one structural element may comprise a drive wheel rotating block having a raised crescent-shaped blocking disk and an upward-protruding pin. The drive wheel rotating block may have a perimeter that is shaped so as to define a circle. A side wall may extend downward from the lower surface of the drive wheel rotating block. The side wheel may have a curvature that defines a plurality of teeth.

In another embodiment of the rotating block, the at least one structural element may comprise a driven wheel rotating block having a perimeter that is shaped so as to define a regular polygon having slots extending inward from each corner towards the center of the driven wheel rotating block and a curve formed into each side of the driven wheel rotating block. The slots may be configured to receive an upward-protruding pin formed on a drive wheel rotating block. The curves may configured to accommodate a blocking disk formed on the drive wheel rotating block.

BRIEF DESCRIPTION OF THE DRAWINGS

Various embodiments of the invention are described in the following detailed description with reference to the accompanying drawings, in which.

DETAILED DESCRIPTION

A toy construction set and its method of manufacture are described herein. The specific details set forth in the following description provide an understanding of certain embodiments of the invention, and do not limit the scope of the invention as set forth in the claims. Certain structures and steps that are well known in the art are not described in detail. Reference is made in the following description to the accompanying drawings. Wherever possible, the same reference numbers are used throughout the drawings and the corresponding description to refer to the same or similar structures or steps.

Figure 1:
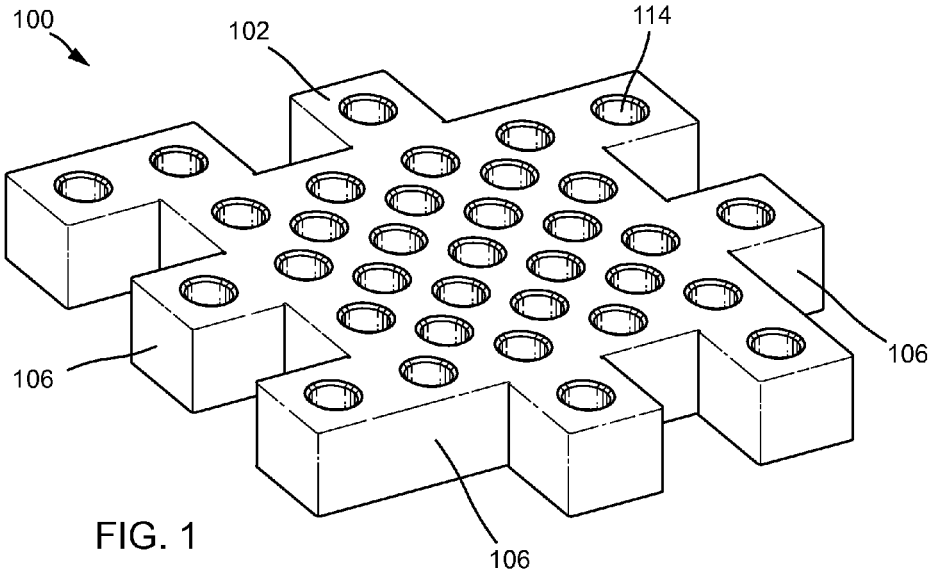
FIG. 1 is a front perspective view showing upper and side surfaces of a base block in accordance with one embodiment of the present invention.
Figure 2:
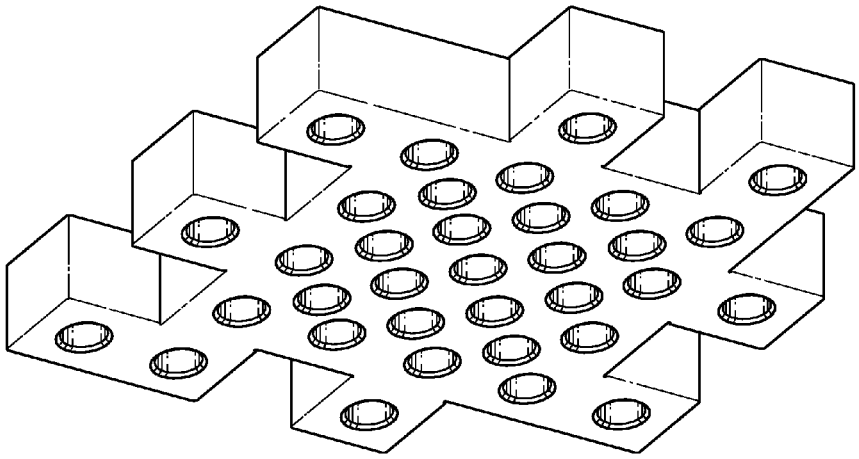
FIG. 2 is a front perspective view showing lower and side surfaces of the base block of FIG. 1.
Figure 3:
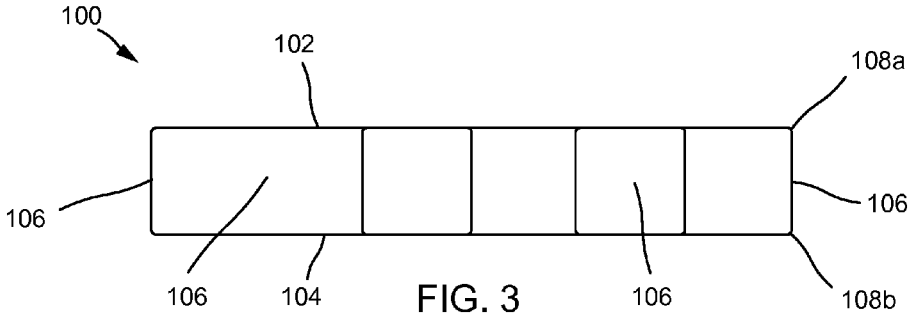
FIG. 3 is a side view showing the base block of FIG. 1.

FIGS. 1 to 3 show a base block 100 in accordance with one embodiment of the present invention. The base block 100 is defined by an upper surface 102, a lower surface 104, and side surfaces 106 extending between the upper and lower surfaces 100 and 102. Upper radii 108*a* may connect the upper surface 102 to the side surfaces 106, and lower radii 108*b* may connect the lower surface 104 to the side surfaces 106. Preferably, upper radii 108*a* and lower radii 108*b* have the same dimensions. In some embodiments, upper and lower chamfers (instead of radii) may connect the side surfaces 106 to the upper and lower surfaces 102 and 104, and in other embodiments, the side surfaces and the upper and lower surfaces 102 and 104 may meet at ninety-degree angles (without chamfers or radii).

Figure 10:
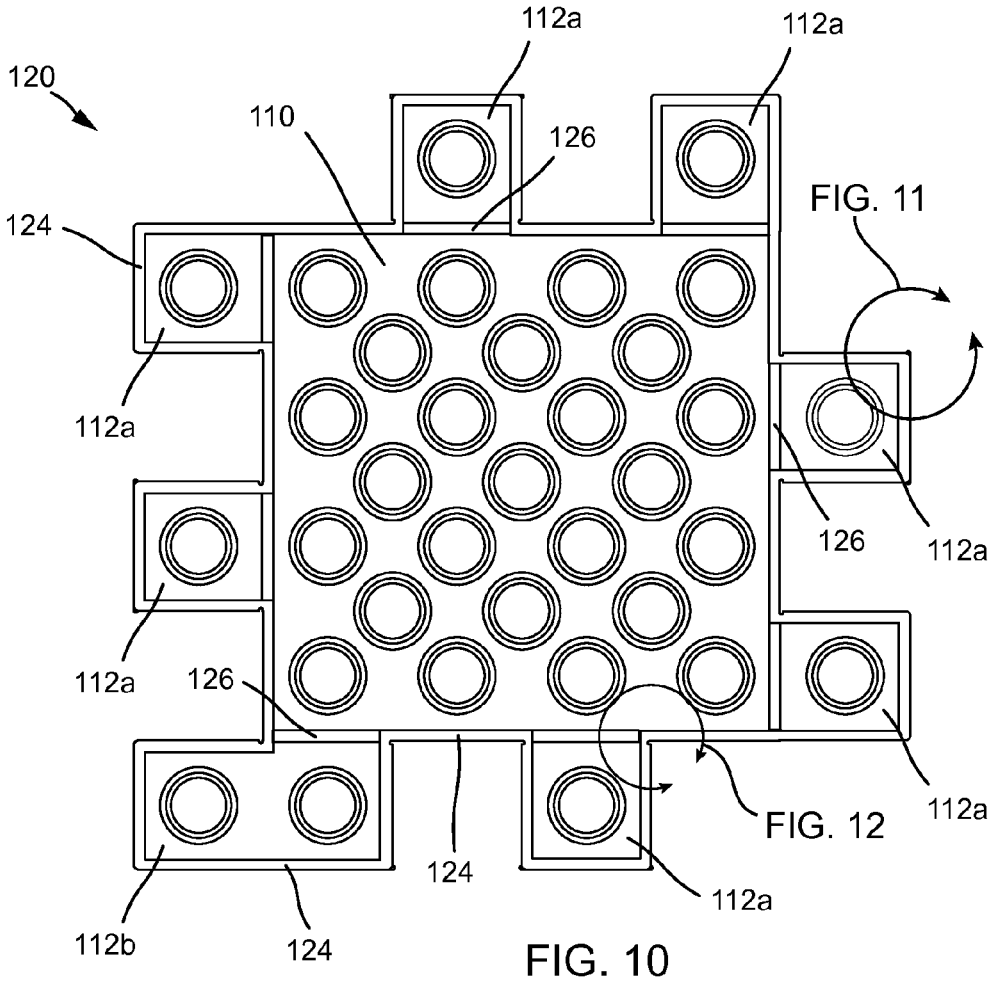
FIG. 10 is a bottom view showing the lower side of the upper base block portion of FIG. 4.

The base block 100 preferably comprises a body 110, best shown in FIG. 10, from which a plurality of projections 112 extend outward. The body 110 is preferably formed in the shape of a rectangular cuboid. As shown, the body 110 is formed in the shape of a square cuboid (i.e. a rectangular cuboid having at least two square surfaces). The embodiment shown includes a total of eight projections 112, with two projections 112 extending outward from each side of the body 110. All but one of the projections 112*a* in this embodiment are formed in the shape of a cube, and the remaining projection 112*b* is formed in the shape of a square cuboid that is approximately twice the size of each cube-shaped projection 112*a*. The projections 112 of the base block 100 are preferably configured to mate with projections formed on other similarly configured base blocks, thereby facilitating the coupling of multiple base blocks to one another in either a planar or an orthogonal configuration.

Holes 114 may be formed vertically through the base block 100, thereby defining interior cylindrical surfaces 116 (see FIG. 9*b*) that extend between the upper surface 102 and the lower surface 104. Upper chamfers 118*a* (see FIG. 9*a*) may connect the cylindrical surfaces 116 with the upper surface 102, and lower chamfers 118*b* (see FIG. 9*a*) may connect the cylindrical surfaces 116 with the lower surface 104. Preferably, upper chamfers 118*a* and lower chambers 118*b* have the same dimensions. In the embodiment shown, a plurality of interior cylindrical surfaces 116 extend through the body 110 of the base block 100 in a quincunx pattern, a single interior cylindrical surface 116 extends through each cube-shaped projection 112*a*, and two interior cylindrical surfaces 116 extend through square cuboid-shaped projection 112*b*.

Figure 4:
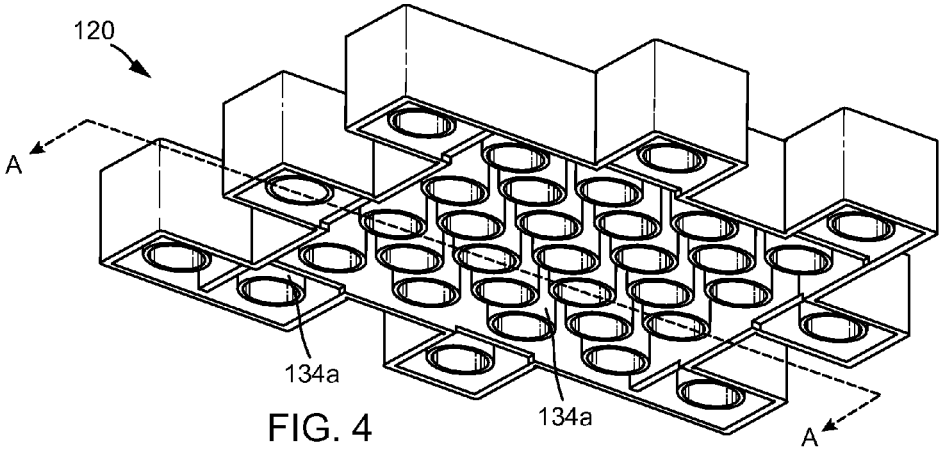
FIG. 4 is a front perspective view showing the lower side of an upper base block portion in accordance with one embodiment of the present invention.
Figure 5:
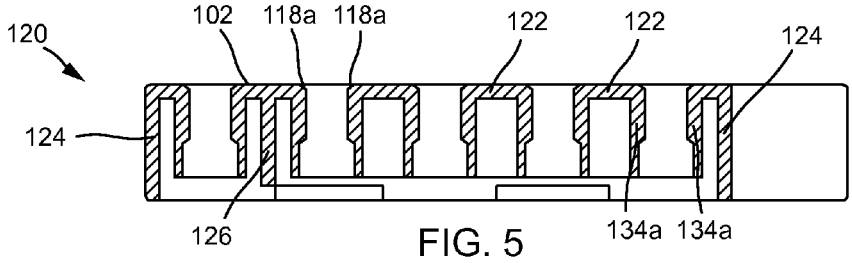
FIG. 5 is a sectional view of the upper base block portion of FIG. 4.
Figure 6:
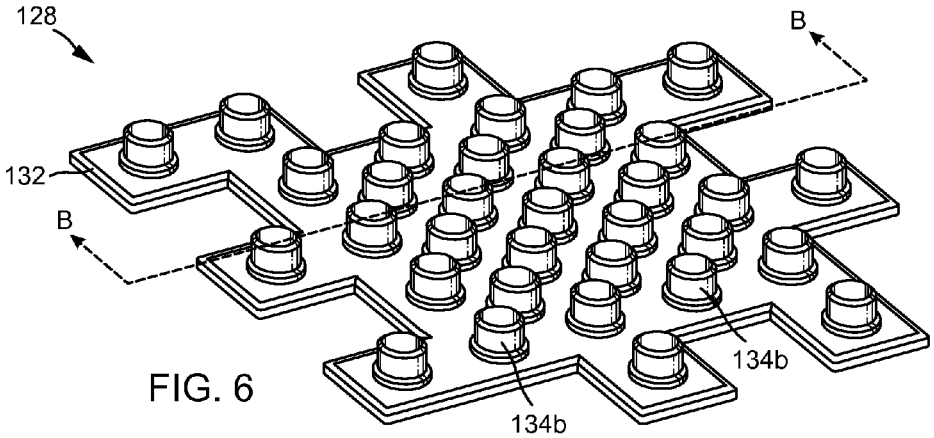
FIG. 6 is a front perspective view showing the upper side of a lower base block portion in accordance with one embodiment of the present invention.
Figure 7:
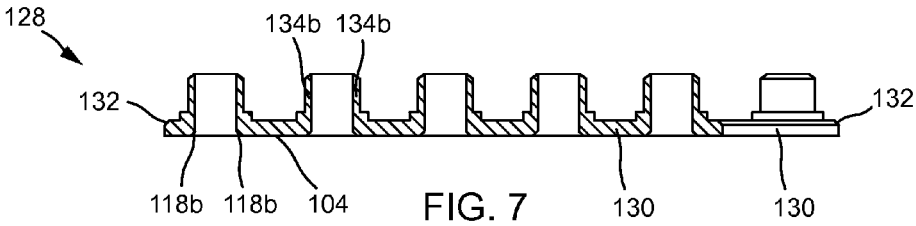
FIG. 7 is a sectional view of the lower base block portion of FIG. 6.

In the preferred configuration, the base block 100 is formed from an upper base block portion 120 and a lower base block portion 128. The upper base block portion 120, shown in FIGS. 4 and 5, may comprise an upper wall 122 and side walls 124. In the configuration shown in FIG. 4, the upper base block portion 112 also includes partition walls 126, which define the boundary between the body 110 and the projections 112 of the base block 100. The lower base block portion 128, shown in FIGS. 6 and 7, may comprise a lower wall 130. A chamfer 132 may be formed at the intersection of the upper surface and side edges of the lower wall 130. The chamfer 132 facilitates attachment of the lower base block portion 128 to the upper base block portion 120.

Figure 8:
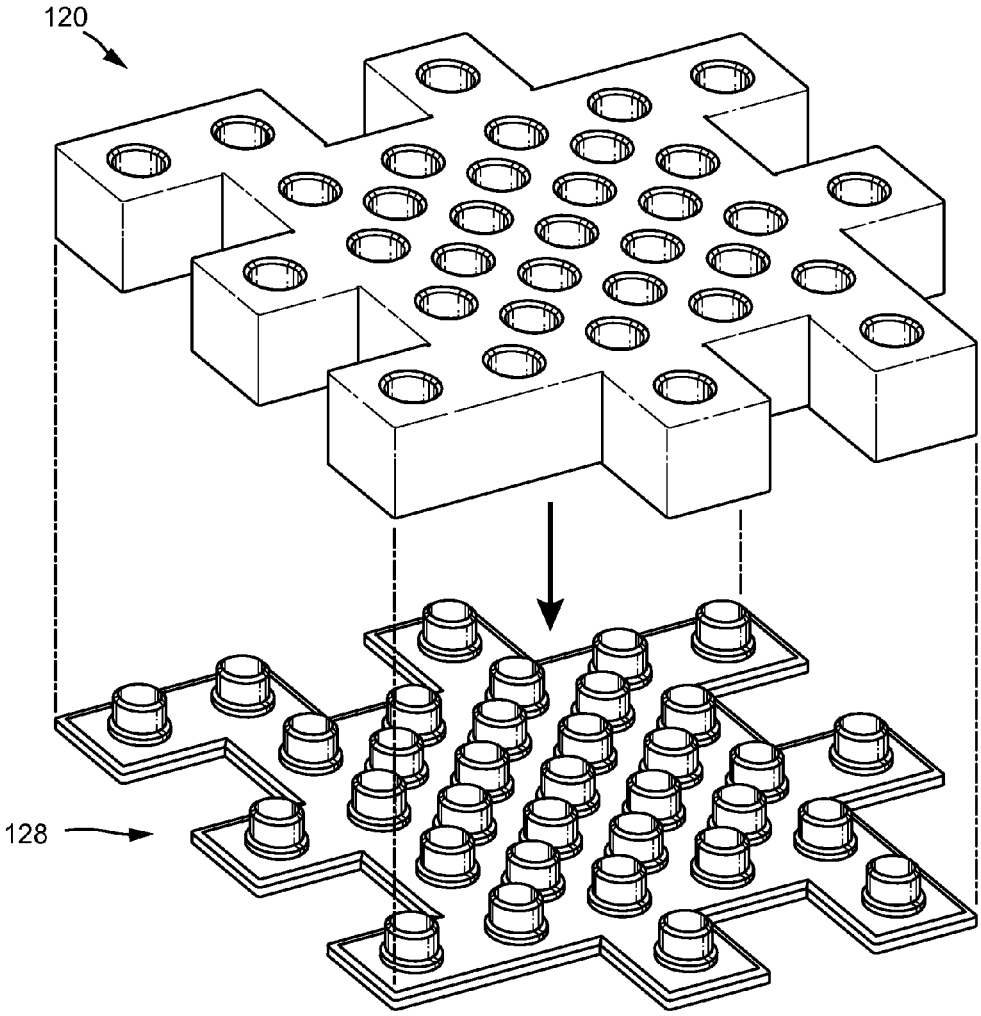
FIG. 8 is a perspective view showing the assembly of the upper base block portion of FIG. 4 with the lower base block portion of FIG. 6.
Figure 9A:
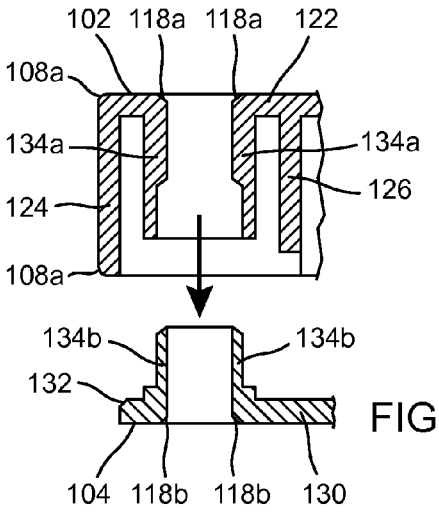
FIG. 9*a* is a sectional view showing the assembly of the upper base block portion of FIG. 4 with the lower base block portion of FIG. 6.
Figure 9B:
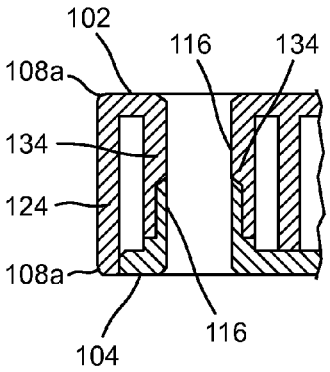
FIG. 9*b* is a sectional view showing an assembly of the upper base block portion of FIG. 4 with the lower base block portion of FIG. 6.

The upper and lower base block portions 120 and 128 can be coupled together in the manner shown in FIGS. 8, 9*a*, and 9*b*. In the configuration shown, a plurality of upper column portions 134*a* extend downward from the lower surface of the upper wall 122, and a plurality of corresponding lower column portions 134*b* extend upward from the upper surface of the lower wall 130. When the upper and lower base block portions 120 and 128 are joined, the lower surface of the lower wall 130 becomes flush with the lower edges of the sidewalls 124, and the upper and lower column portions 134*a* and 134*b* mesh with each other to form hollow cylindrical columns 134 that define the interior cylindrical surfaces 116 of the base block 100.

Figure 11:
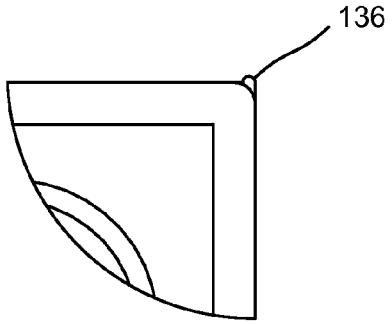
FIG. 11 is a bottom view showing a ridge formed along an outermost vertical edge of a projection of the upper base block portion of FIG. 4.
Figure 12:
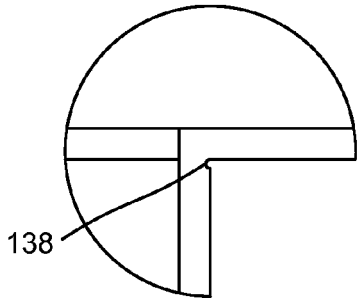
FIG. 12 is a bottom view showing a notch formed along an innermost vertical edge of a projection of the upper base block portion of FIG. 4.
Figure 13:
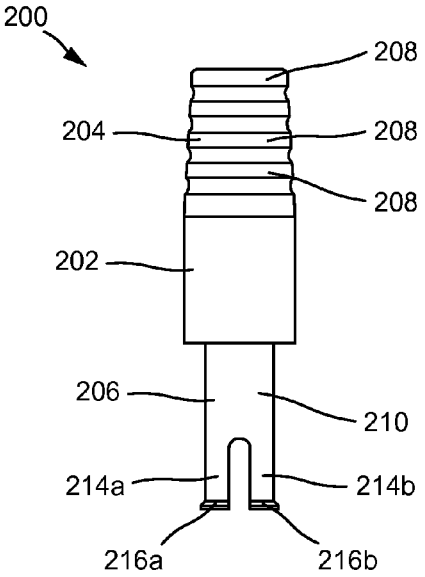
FIG. 13 is a front view of a hub in accordance with one embodiment of the present invention.
Figure 14:
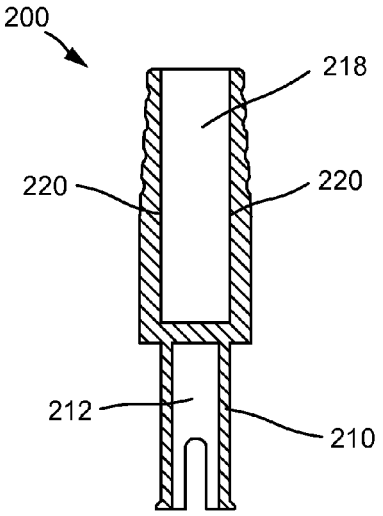
FIG. 14 is a sectional view of the hub of FIG. 13.
Figure 15:
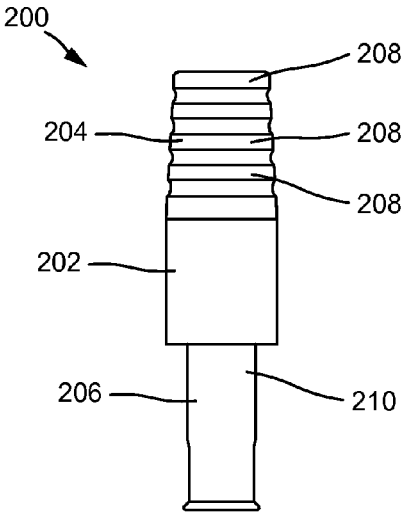
FIG. 15 is a side view of the hub of FIG. 13.
Figure 16:
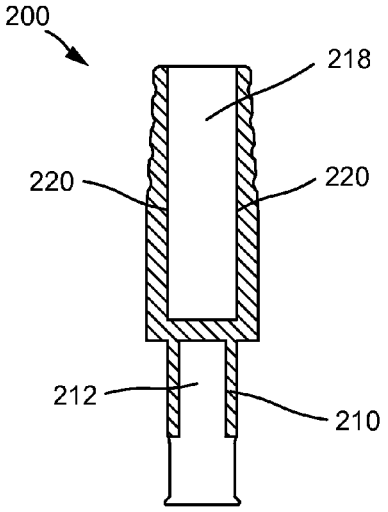
FIG. 16 is a side sectional view of the hub of FIG. 13.
Figure 17:
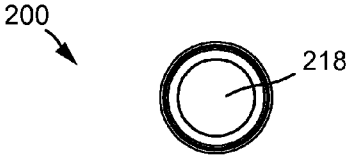
FIG. 17 is a top view of the hub of FIG. 13.
Figure 18:
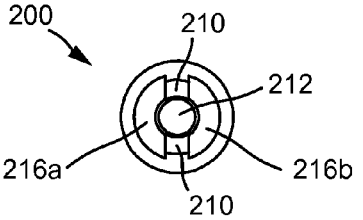
FIG. 18 is a bottom view of the hub of FIG. 13.
Figure 19:
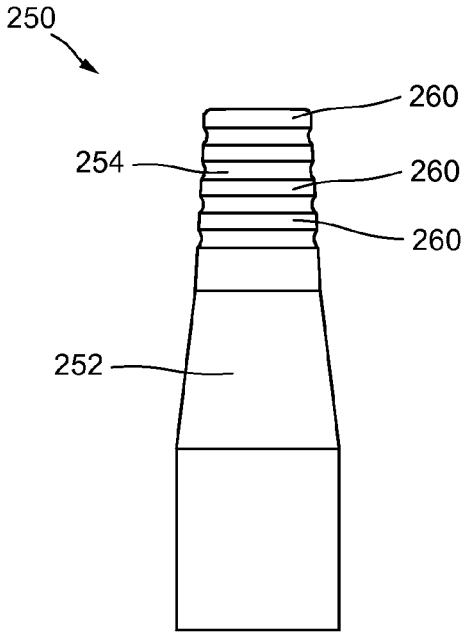
FIG. 19 is a front view of a hub in accordance with another embodiment of the present invention.
Figure 20:
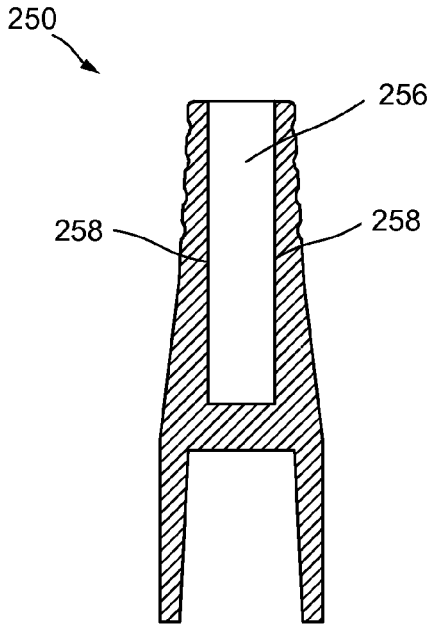
FIG. 20 is a sectional view of the hub of FIG. 19.
Figure 21:
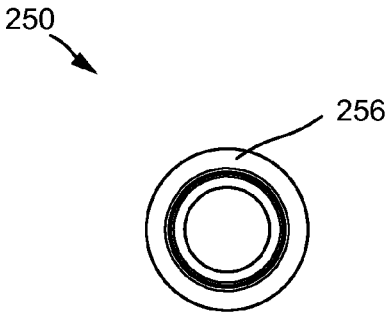
FIG. 21 is a top view of the hub of FIG. 19.
Figure 22:
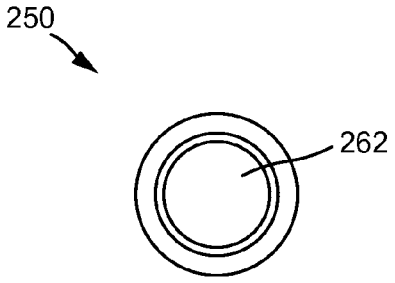
FIG. 22 is a bottom view of the hub of FIG. 19.
Figure 23:
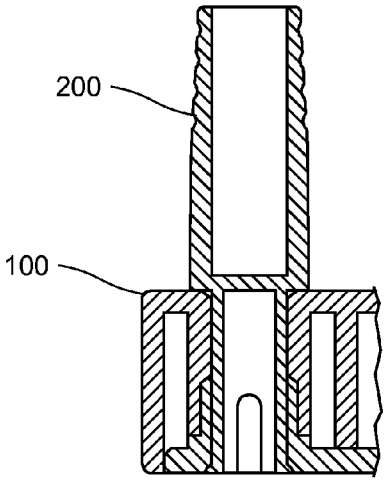
FIG. 23 is a sectional view showing the hub of FIG. 13 coupled to the base block of FIG. 9*b;*
Figure 24:
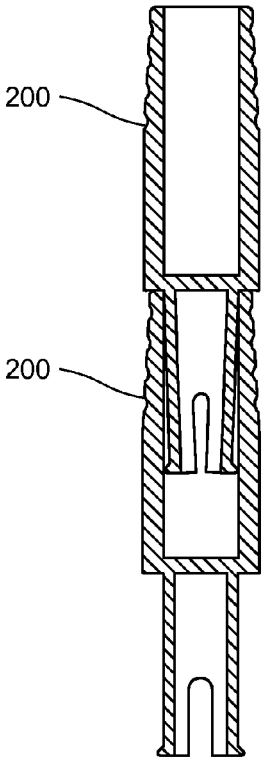
FIG. 24 is a sectional view showing the hub of FIG. 13 coupled to another hub of FIG. 13.
Figure 25:
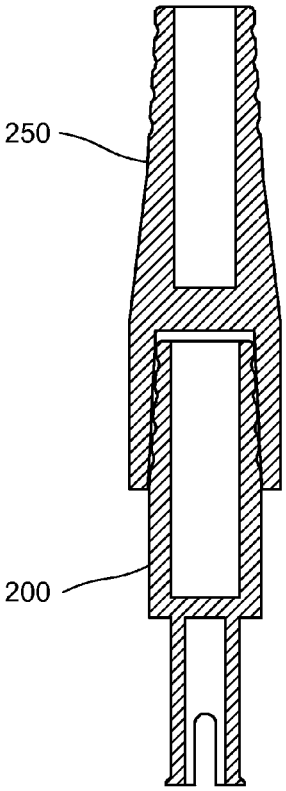
FIG. 25 is a sectional view showing the hub of FIG. 19 coupled to the hub of FIG. 13.
Figure 26:
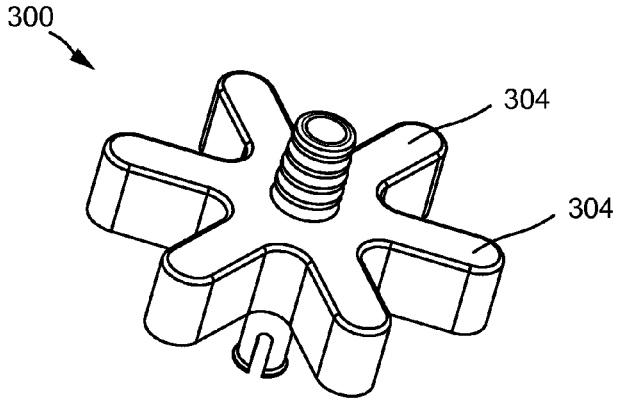
FIG. 26 is a perspective view showing a spur gear rotating block in accordance with one embodiment of the present invention.
Figure 27:
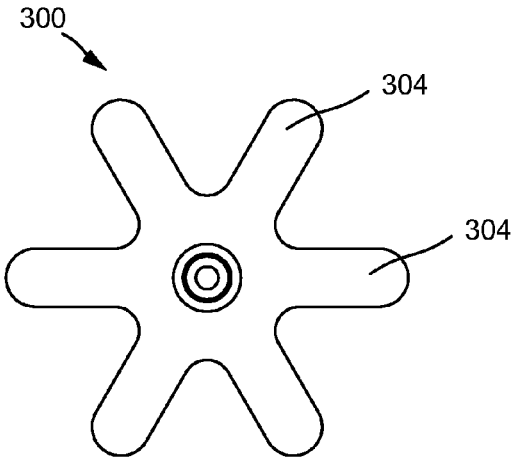
FIG. 27 is a top view showing the spur gear rotating block of FIG. 26.
Figure 28:
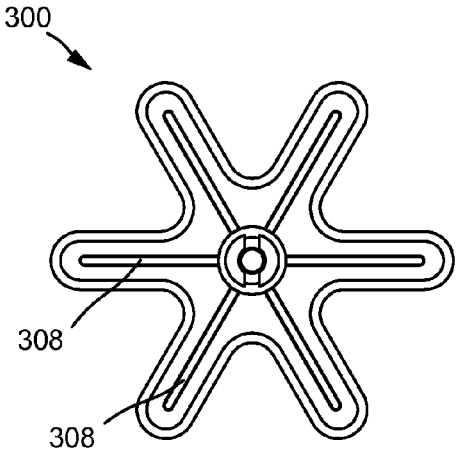
FIG. 28 is a bottom view showing the spur gear rotating block of FIG. 26.
Figure 29:
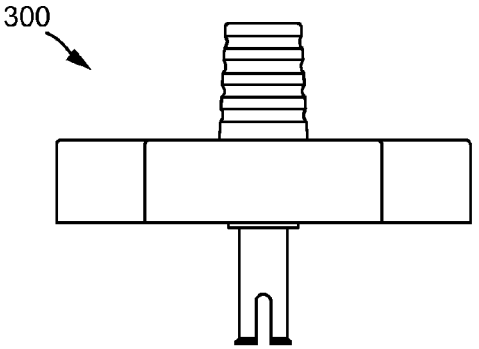
FIG. 29 is a front view showing the spur gear rotating block of FIG. 26.
Figure 30:
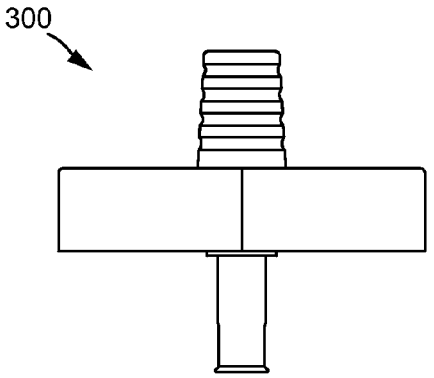
FIG. 30 is a side view showing the spur gear rotating block of FIG. 26.
Figure 31:
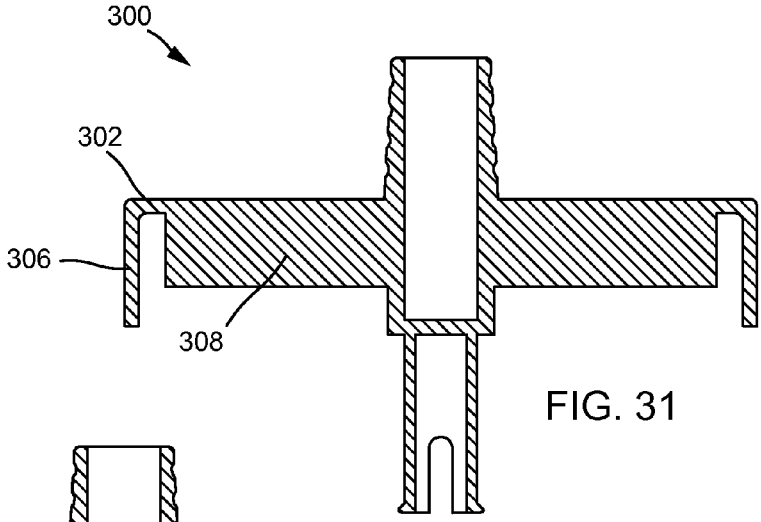
FIG. 31 is sectional view showing the spur gear rotating block of FIG. 26.
Figure 32:
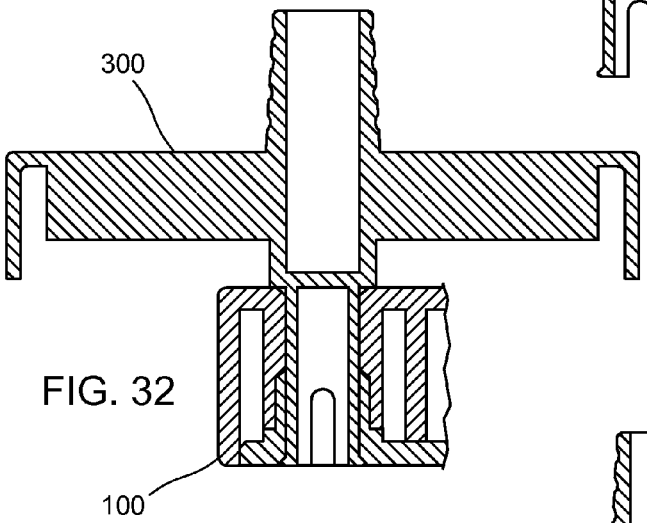
FIG. 32 is a sectional view showing the spur gear rotating block of FIG. 26 coupled to the base block of FIG. 9*b;*
Figure 33:
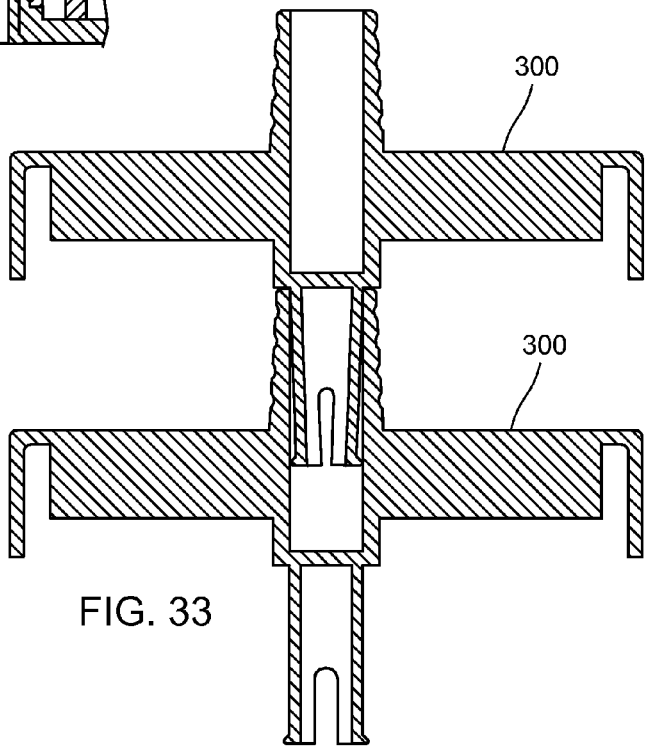
FIG. 33 is a sectional view showing the spur gear rotating block of FIG. 26 coupled to another spur gear rotating block of FIG. 26.
Figure 34:
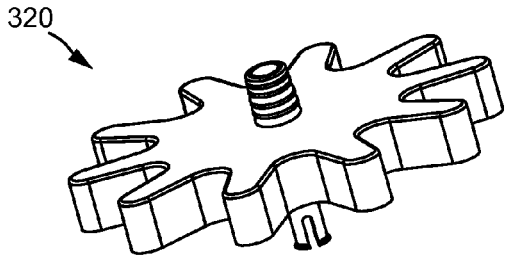
FIG. 34 is a perspective view showing a spur gear rotating block in accordance with another embodiment of the present invention.
Figure 35:
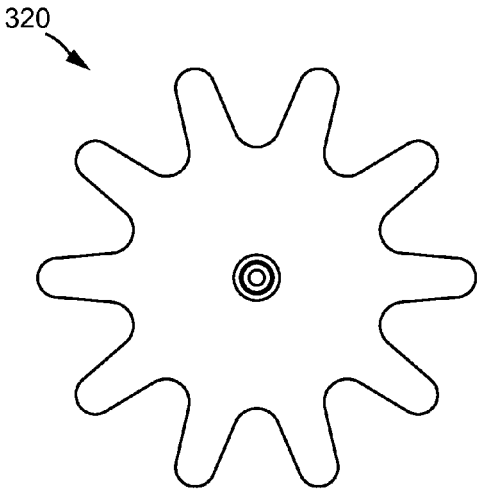
FIG. 35 is a top view showing the spur gear rotating block of FIG. 34.
Figure 36:
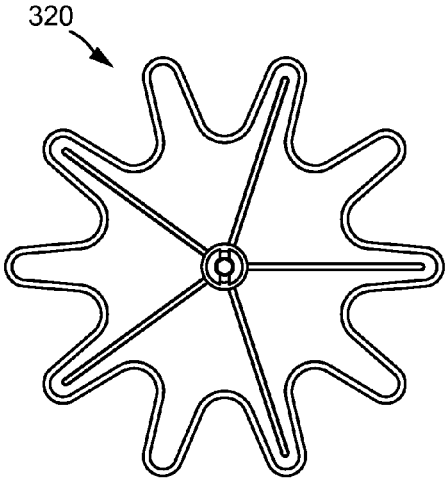
FIG. 36 is a bottom view showing the spur gear rotating block of FIG. 34.
Figure 37:
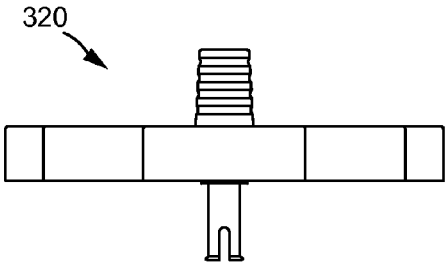
FIG. 37 is a front view showing the spur gear rotating block of FIG. 34.
Figure 38:
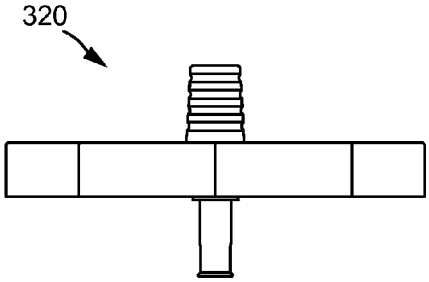
FIG. 38 is a side view showing the spur gear rotating block of FIG. 34.
Figure 39:
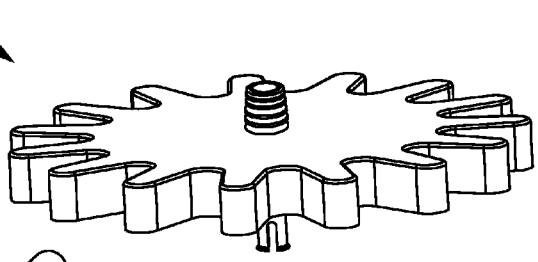
FIG. 39 is a perspective view showing a spur gear rotating block in accordance with another embodiment of the present invention.
Figure 40:
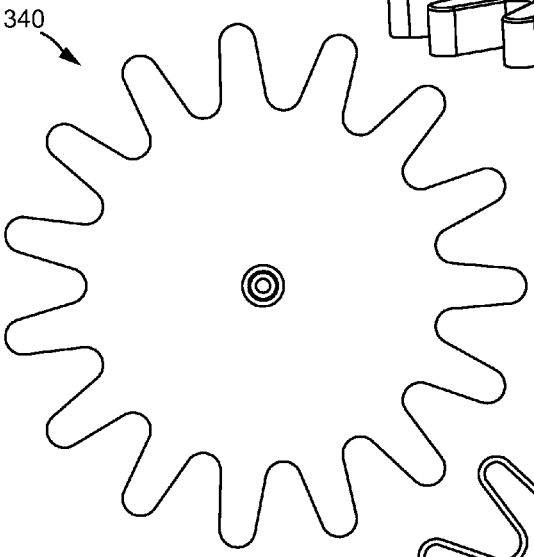
FIG. 40 is a top view showing the spur gear rotating block of FIG. 39.
Figure 41:
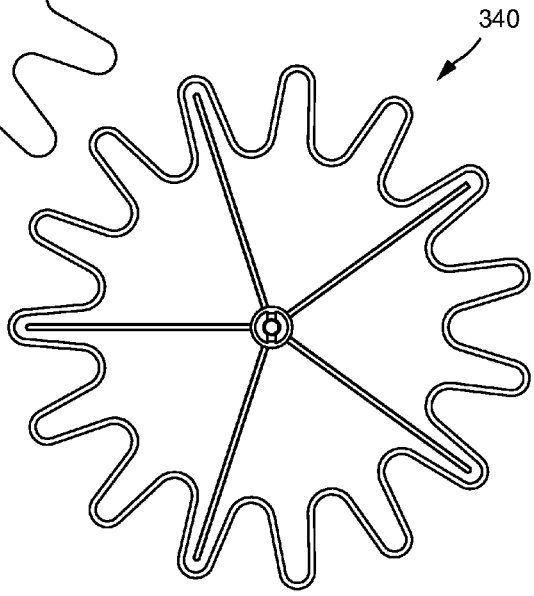
FIG. 41 is a bottom view showing the spur gear rotating block of FIG. 39.
Figure 42:
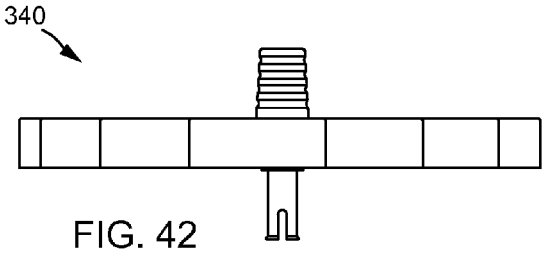
FIG. 42 is a front view showing the spur gear rotating block of FIG. 39.
Figure 43:
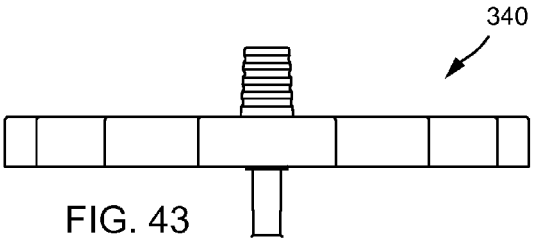
FIG. 43 is a side view showing the spur gear rotating block of FIG. 39.
Figure 44:
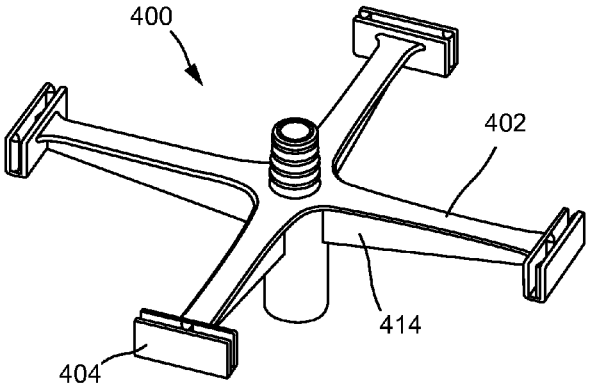
FIG. 44 is a perspective view showing a picture holder rotating block in accordance with one embodiment of the present invention.
Figure 45:
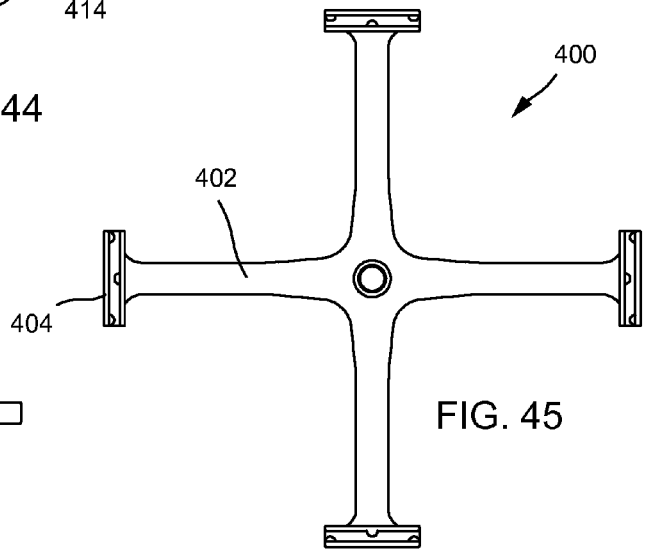
FIG. 45 is a top view showing the picture holder rotating block of FIG. 44.
Figure 46:
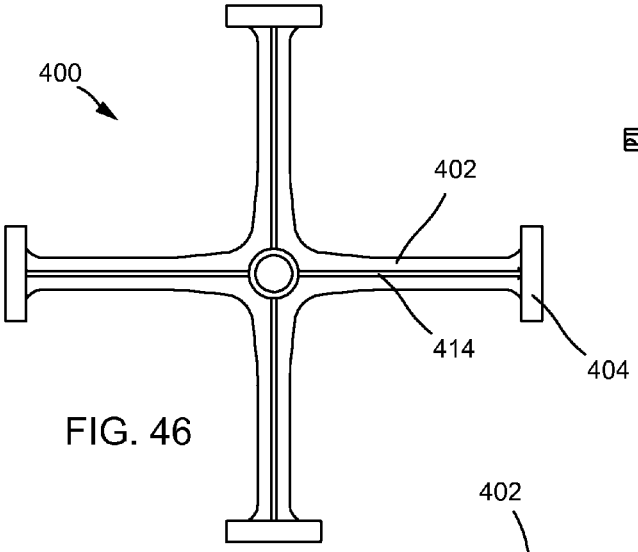
FIG. 46 is a bottom view showing the picture holder rotating block of FIG. 44.
Figure 47:
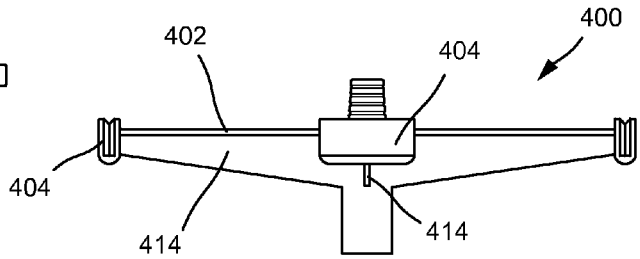
FIG. 47 is a front view showing the picture holder rotating block of FIG. 44.
Figure 48A:
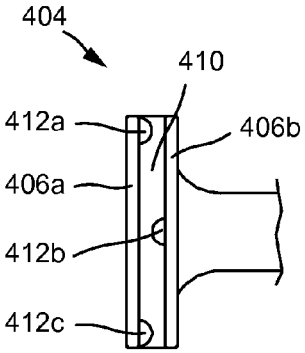
FIG. 48*a* is a top view of a slotted picture holder in accordance with one embodiment of the present invention.
Figure 48B:
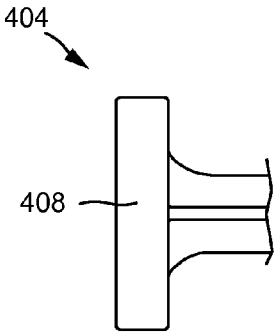
FIG. 48*b* is a bottom view of the slotted picture holder of FIG. 48*a;*
Figure 48C:
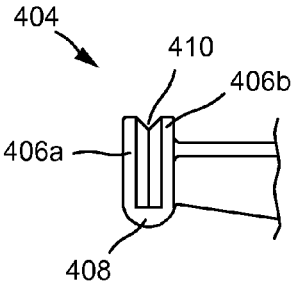
FIG. 48*c* is a front view of the slotted picture holder of FIG. 48*a;*
Figure 49:
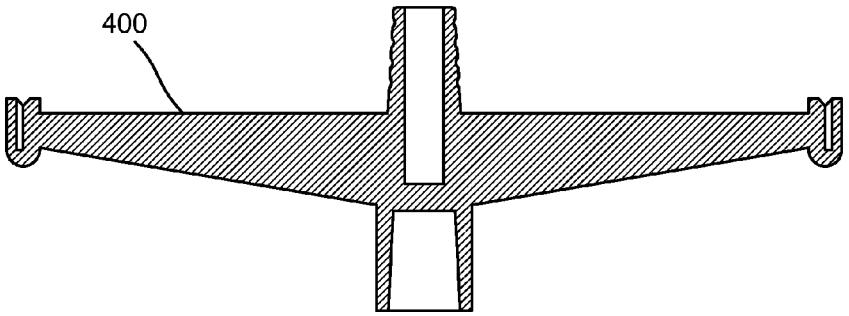
FIG. 49 is a sectional view showing the picture holder rotating block of FIG. 44.
Figure 50:
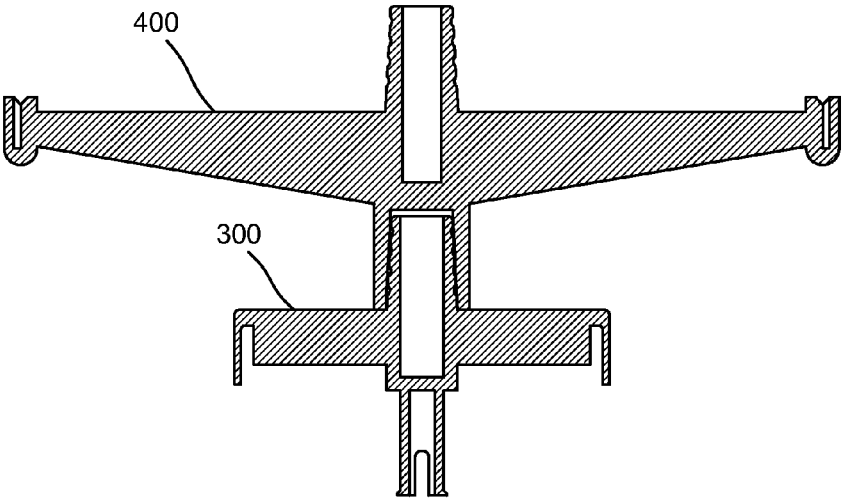
FIG. 50 is a sectional view showing the picture holder rotating block of FIG. 44 coupled to the spur gear rotating block of FIG. 26.
Figure 51:
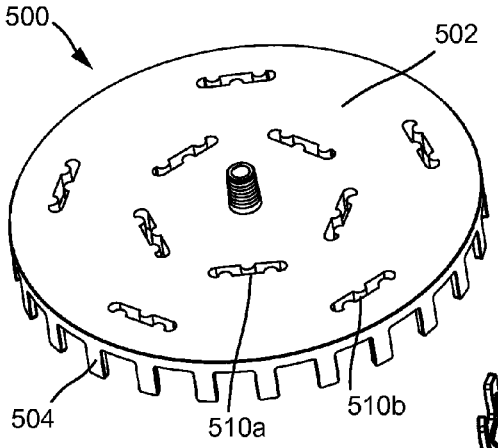
FIG. 51 is a perspective view showing the upper surface of a fold-up toy support rotating block in accordance with another embodiment of the present invention.
Figure 52:
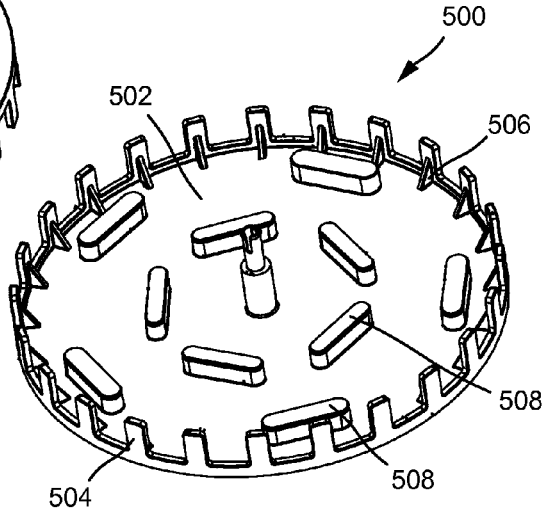
FIG. 52 is a perspective view showing the lower surface of the fold-up toy support rotating block of FIG. 51.
Figure 53:
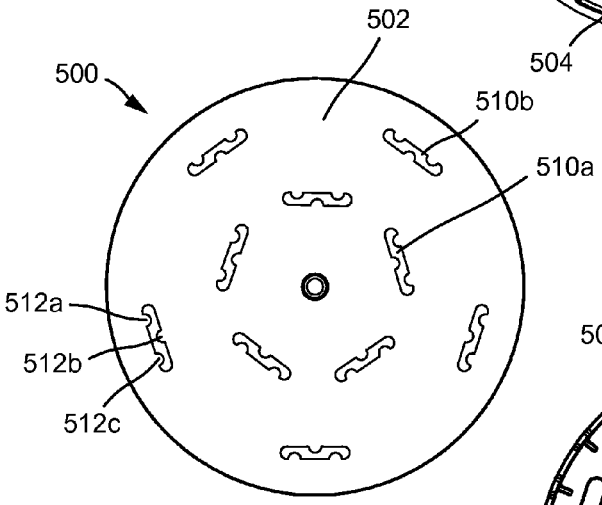
FIG. 53 is a top view showing the fold-up toy support rotating block of FIG. 51.
Figure 54:
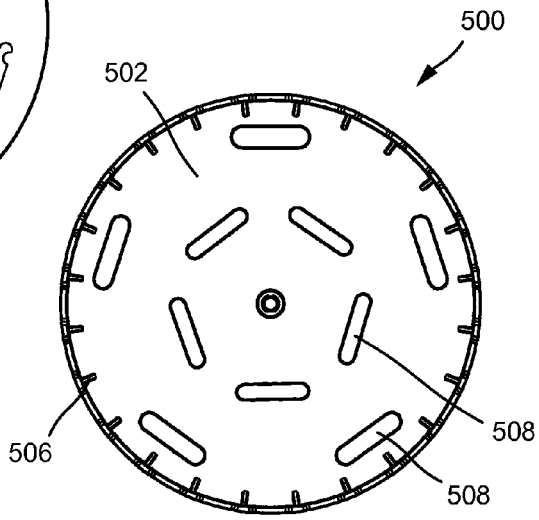
FIG. 54 is a bottom view showing the fold-up toy support rotating block of FIG. 51.
Figure 55:
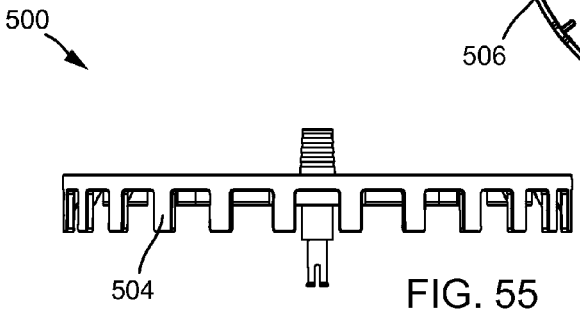
FIG. 55 is a front view showing the fold-up toy support rotating block of FIG. 51.
Figure 56:
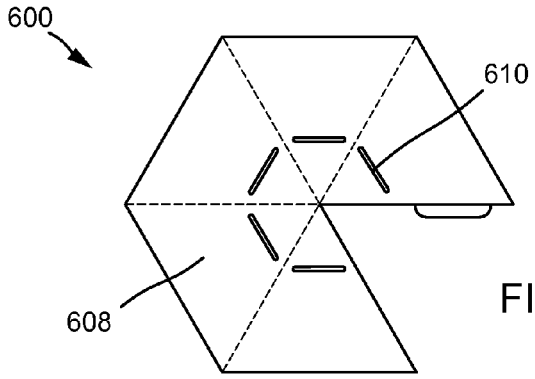
FIGS. 56 to 58 are a top views of a fold-up carousel toy in accordance with one embodiment of the present invention.
Figure 57:
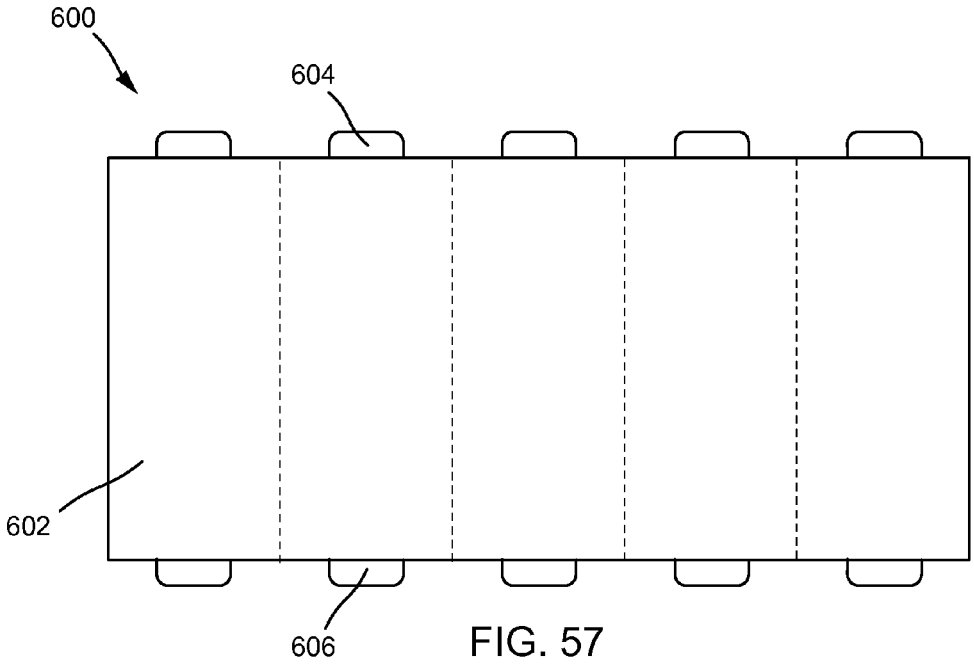
Figure 58:
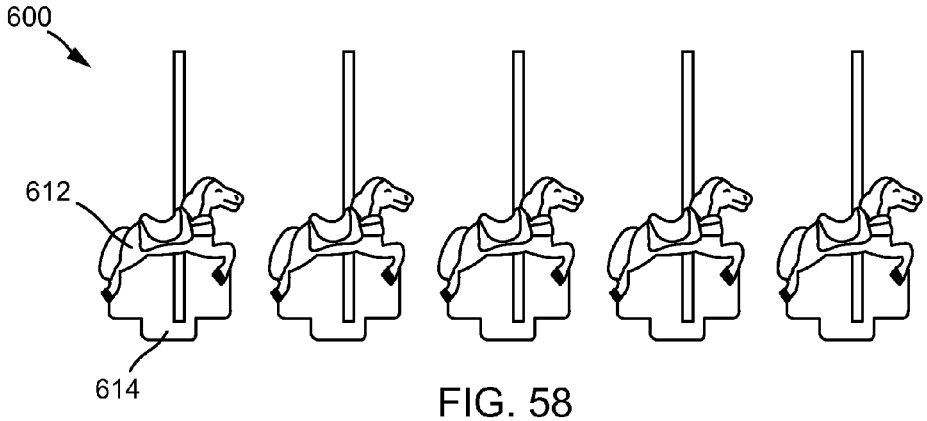
Figure 59:
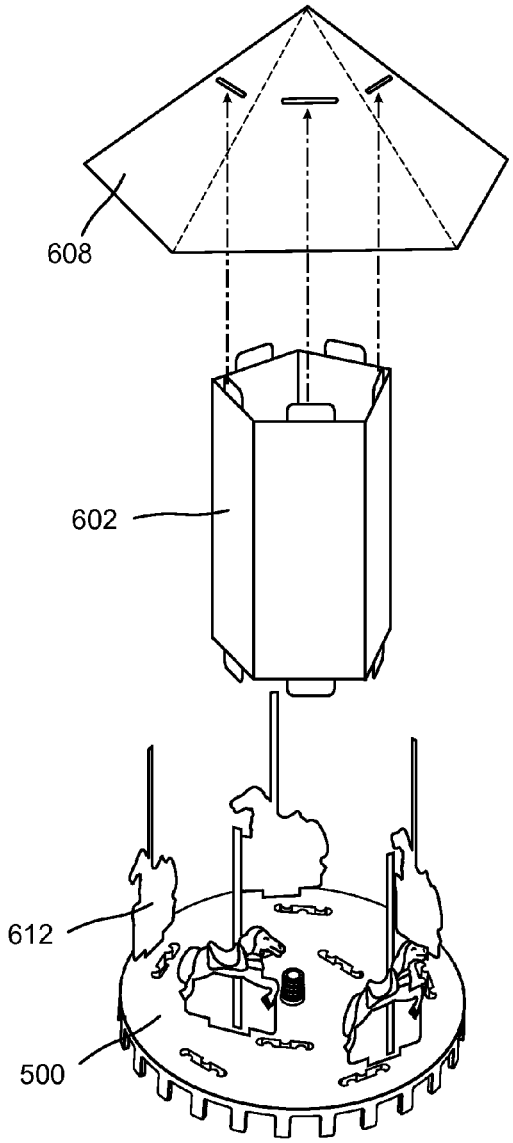
FIG. 59 is a perspective view showing the assembly of the fold-up carousel toy of FIGS. 56 to 58 with the fold-up toy support rotating block of FIG. 51.
Figure 60:
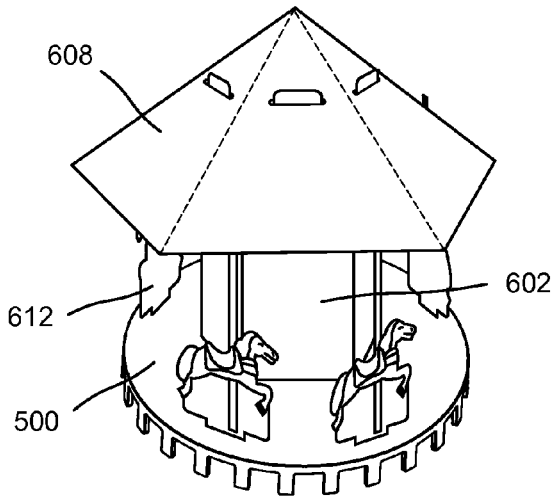
FIG. 60 is a perspective view showing an assembly of the fold-up carousel toy of FIGS. 56 to 58 with the fold-up toy support rotating block of FIG. 51.

Ridges 136 may be formed along at least a portion of the length of the outermost vertical edges of at least some of the projections 112, and notches 138 may be formed along at least a portion of the innermost vertical edges of at least some of the projections 112, as shown in FIGS. 10 to 12. As used in reference to the ridges 136, the term "vertical edge" refers to an edge extending between the upper and lower surfaces 102 and 104 of the base block 100. The ridges 136 formed on the block 100 may be configured to engage with the notches 138 formed on adjacent blocks, thereby improving the interconnection between adjacent blocks when they are coupled to one another in a planar configuration. The ridges 136 may also be configured to engage with upper and lower radii 108*a* and 108*b* or chamfers formed on adjacent blocks, thereby improving the interconnection between adjacent blocks when they are coupled to one another in an orthogonal configuration. In the preferred configuration, the ridges 136 and the notches 138 both have a cylindrical shape with a radius of 0.15 millimeters, although other shapes and sizes may be used.

The toy construction set may include one or more rotating blocks that are configured for coupling to the base block 100, to other rotating blocks, or to both. The rotating blocks generally comprise a hub from which other structural elements in the rotating block emanate. Preferably, the hub is generally symmetrical around a vertical axis that serves as the center of rotation for the rotating block. The rotating blocks may be in the form of various types of structures such as gears, picture holders, or supports for fold-up toys that can be attached to the block to resemble carousels, castles, or other structures. The rotating blocks are not limited to these examples, and the present invention contemplates other types of rotating blocks that can be formed in accordance with the principles recited herein.

FIGS. 13 to 18 show a hub 200 in accordance with one embodiment of the present invention. The hub 200 of this embodiment includes a body 202, a grip 204 extending upward from the upper end of the body 202, and a coupling mechanism 206 extending downward from the lower end of the body 202. The body 202 is the portion of the hub 200 from which the other structures of a rotating block emanate. Preferably, the grip 204 is configured to be held by a user so as to improve the ease with which a rotating block can be handled. Thus, the grip 204 may facilitate attachment of a rotating block to, and removal of a rotating block from, a base block or another rotating block. In the embodiment shown, a series of ridges 208 are formed at approximately regular intervals around the exterior side surface of the grip 204. The ridges 208 may progressively increase in diameter from the upper-most ridge (i.e., the ridge that is farthest away from the body) to the lower-most ridge closest to the body 202 (i.e., the ridge that is closest to the body). The grip 204 is not, however, limited to any particular configuration, and other shapes and designs are contemplated by the present invention.

The coupling mechanism 206 of this embodiment is in the form of a push-in fastener comprising a cylindrical column 210 (which may, or may not, have a hole 212 formed upward from its lower end through at least a portion of the length of its axis) that is slotted at its lower end to form first and second resilient legs 214*a* and 214*b*. Preferably, projections 216*a* and 216*b* are formed on the exterior side surfaces of the legs 214*a* and 214*b* at their lower ends. The projections 216*a* and 216*b* may be configured to engage a chamfer 118*a* or 118*b* connecting an interior cylindrical surface 116 to the upper or lower surface 102 and 104 of a base block 100 when a rotating block is coupled to a base block. The projections 216*a* and 216*b* preferably improve the coupling of the rotating block to a base block, while allowing the rotating block to rotate relative to the base block, and while allowing the rotating block to be decoupled from the base block by pulling on the grip 204. The configuration of the coupling mechanism 206 can be adjusted to control the amount of force that must be applied to the grip 204 to remove the rotating block from the base block. For example, providing a hole 212 through the axis of the cylindrical column 210, increasing the length or width of the slot through the cylindrical column 210, or reducing the size of the projections 216*a* and 216*b* may reduce the amount of force that must be applied to the grip 204 to remove the rotating block from the base block.

Preferably, a hole 218 is formed downward from the upper end of the hub 200 through at least a portion of the length of its axis. The hole 218 may extend downward through at least a portion of the length of the axis of the grip 204, and optionally may extend downward through the entire length of the axis of the grip 204 and at least a portion of the length of the axis of the body 202. In the preferred configuration, the diameter of the hole 218 is approximately equal to the exterior diameter of the cylindrical column 210, such that the coupling mechanism 206 of another rotating block can be received into the hole 218 in the grip 204. Optionally, one or more notches (not shown), which are configured to receive projections 216*a* and 216*b* formed on the coupling mechanism 206 of an attached rotating block, may be formed in the interior cylindrical surface 220 defined by the hole 218. The notches may improve the coupling of one rotating block to another, in the same manner that the chamfers 118*a* and 118*b* may improve the coupling of a rotating block to a base block. Furthermore, a key (not shown), configured to be received into the slot between the first and second resilient legs 214*a* and 214*b*, may be formed partially or entirely across the hole 218. In this configuration, the key and the slot form a keyed joint when two rotating blocks are coupled together, thereby preventing the blocks from rotating relative to one another.

FIGS. 19 to 22 show a hub 250 in accordance with another embodiment of the present invention. Similar to hub 200 of the previous embodiment, hub 250 includes a body 252 and a grip 254 extending upward from the upper end of the body 252. The grip 254 may have a similar structure as the grip 204 of hub 200. In particular, a series of ridges 260, which may progressively increase in diameter from the upper-most ridge to the lower-most ridge 252, may be formed at approximately regular intervals around the exterior side surface of the grip 254. As with grip 204 of hub 200, grip 254 is not limited to any particular configuration, and other shapes and designs are contemplated by the present invention.

A hole 256 configured for receiving the coupling mechanism 206 of another rotating block may be formed downward from the upper end of the hub 200 through at least a portion of the length of its axis. The hole 256 may extend downward through at least a portion of the length of the axis of the grip 254, and optionally may extend downward through the entire length of the axis of the grip 254 and at least a portion of the length of the axis of the body 252. Notches (not shown) configured for receiving the projections 216*a* and 216*b* formed on the coupling mechanism 206 of an attached rotating block may be formed in the interior cylindrical surface 258 defined by the hole 256. Furthermore, a key (not shown), configured to be received into the slot between the first and second resilient legs 214*a* and 214*b* of an attached rotating block, may be formed partially or entirely across the hole 256.

Unlike hub 200 of FIGS. 13 to 18, hub 250 does not include a separate coupling mechanism extending downward from the lower end the body 252. Rather, a hole 262 may be formed upward from the lower end of the body 252 through at least a portion of the length of its axis. The hole 262 may be configured to receive the grip 204 or 254 of another rotating block. In the configuration shown, the hole 262 defines an interior side surface 264 that is tapered, having a diameter that is greatest at its lower end and that decreases linearly upwards through the body, so as to have dimensions that approximately match the diameter of the ridges 208 or 260 formed around the exterior side surface of a grip 204 or 254. In other configurations, the surface 264 may have a different configuration. For example, in some embodiments, the interior side surface 264 may be cylindrical rather than tapered. The exterior side surface of the body 252 may include a tapered portion 252*a* and a cylindrical portion 252*b*. Alternatively, the exterior side surface of the body 252 may be tapered along its entire length, may be cylindrical along its entire length, or may have some other configuration. The configuration shown in FIGS. 19 to 22 facilitates coupling of the body 252 to the grip 204 or 254 of another rotating block. Thus, a rotating block that is formed with hub 250 can be coupled to another rotating block, but it cannot be coupled to a base block 100 since it does not have a coupling mechanism 206 of the type included in hub 200.

FIGS. 26 to 31 show a spur gear rotating block 300 in accordance with one embodiment of the present invention. The spur gear rotating block 300 of this embodiment uses a hub 200 of the type shown in FIGS. 13 to 18, although other embodiments of the spur gear rotating block may use a hub of another design, such as a hub 250 of the type shown in FIGS. 19 to 22. A spur gear body 302 emanates from the body 202 of the hub 200. The spur gear body 302 may have a generally uniform thickness and a perimeter that is shaped so as to define a plurality of teeth 304. Preferably, the upper and lower surfaces of the spur gear body 302 are orthogonal to the axis of the hub 200. In the configuration shown in FIGS. 26 to 31, the spur gear body 302 is relatively thin compared to the height of the body 202 of the hub 200, and the upper surface of the spur gear body 302 intersects the body 202 of the hub 200 at its upper end. A side wall 306 having a generally uniform height may extend downward from the perimeter of the spur gear body 302. Preferably, the side wall 306 has a curvature that matches the tooth-shaped perimeter of the spur gear body 302. Gusset panels 308 may be formed along the lower surface of the spur gear body 302 and may be coupled to the body 202 of the hub 200. Optionally, the gusset panels 308 may also be coupled to the inner side surface of the side wall 306. Preferably, the lower edges of the gusset panels 308 intersect the body 202 of the hub 200 at a location above its lower end, and the lower edge of the side wall 306 lies in a plane that intersects the body 202 of the hub 200 at a location above its lower end, thereby providing clearance between the side wall 306 and gusset panels 308 and the surface of a building block 100 to which the spur gear rotating block 300 may be attached.

In some embodiments (not shown), the spur gear rotating block may comprise an upper spur gear body and a lower spur gear body, both of which preferably have a structure similar to that of the spur gear body 302 of the embodiment shown in FIGS. 26 to 31. Preferably, the upper surface of the upper spur gear body intersects the body of the hub at its upper end, and the lower surface of the lower spur gear body intersects the body of the hub at a location slightly above its lower end. A side wall, which preferably has a structure similar to that of the side wall 306 of the embodiment shown in FIGS. 26 to 31, may extend between the perimeters of the upper and lower spur gear bodies. In other embodiments (not shown), the spur gear rotating block may comprise a single spur gear body that is thicker than, but otherwise has a structure similar to that of the spur gear body 302 of the embodiment shown in FIGS. 26 to 31. Preferably, the upper surface of the spur gear body intersects the body of the hub at its upper end, and the lower surface of the spur gear body intersects the body of the hub at a location slightly above its lower end. In embodiments using a thicker spur gear body, the side wall and gusset panels may be omitted.

Other variations in the size, shape, and configuration of the spur gear rotating block 300 are contemplated by the present invention. For example, FIGS. 34 to 38 show a spur gear rotating block 320 in accordance with another embodiment of the invention, and FIGS. 39 to 43 show a spur gear rotating block 340 in accordance with yet another embodiment. The spur gear rotating blocks 320 and 340 of these embodiments are similar in design to the spur gear rotating block 300 of FIGS. 26 to 30, differing only the size of the spur gear bodies, the number and shape of the teeth, and the number and arrangement of the gusset panels.

FIGS. 44 to 49 show a picture holder rotating block 400 in accordance with one embodiment of the present invention. The picture holder rotating block 400 of this embodiment uses a hub 250 of the type shown in FIGS. 19 to 22, although other embodiments of the spur gear rotating block may use a hub of another design, such as a hub 200 of the type shown in FIGS. 13 to 18. A picture holder support body 402 emanates from the body 252 of the hub 250. The picture holder support body 402 may have a generally uniform thickness and a perimeter that is shaped so as to define a plurality of support projections 416. Preferably, the upper and lower surfaces of the picture holder support body 402 are orthogonal to the axis of the hub 250. In the configuration shown in FIGS. 44 to 49, the picture holder support body 402 is relatively thin compared to the height of the body 252 of the hub 250, and the upper surface of the picture holder support body 402 intersects the body 252 of the hub 250 at its upper end.

A slotted picture holder 404 may be coupled to the distal end of each support projection 416 of the picture holder support body 402. In the configuration shown in FIGS. 44 to 49, the slotted picture holder 404 has a generally U-shaped structure comprising first and second picture holder arms 406*a* and 406*b* that are both coupled at their lower ends to a picture holder base 408, thereby defining a slot 410 between the arms 406*a* and 406*b* and above the base 408. Preferably, the arms 406*a* and 406*b* are thin rectangular plates having generally flat side surfaces, and the base 408 is a semi-cylindrical block having a flat upper surface. The slotted picture holder 404 may be configured to hold a picture or similar item within the slot 408 between the arms 406*a* and 406*b*. Ridges 412*a*, 412*b*, and 412*c*, which preferably are semi-cylindrical, may be formed vertically along the interior side surfaces of the arms 406*a* and 406*b* to further secure the picture in place within the slot 410. The number, configuration, and location of the ridges 412*a*, 412*b*, and 412*c* may vary in different embodiments. Gusset panels 414 may be formed along the lower surface of the support 402 and may be coupled to both the body 252 of the hub 250 and the second picture holder arm 406*b* of picture holder 404. In the embodiment shown, the height of the gusset panels 414 increases linearly from its distal end to its proximal end, and the lower edges of the gusset panels 414 intersect the body 252 of the hub at the intersection of its tapered and cylindrical portions 252*a* and 252*b*.

In some embodiments (not shown), the picture holder rotating block may comprise a plurality of picture holder support bodies, rather than the single picture holder support body 402 of the embodiment shown in FIGS. 44 to 49. The plurality of picture holder support bodies may have a structure similar to that of the support projections 416 of the picture holder support body 402 shown in FIGS. 44 to 49. In other embodiments (not shown), the picture holder rotating block may comprise a picture holder support body having a perimeter that is shaped so as to define a circle, a polygon, or some other geometric shape, but otherwise has a structure similar to that of the picture holder support body 402 of the embodiment shown in FIGS. 44 to 49. In other embodiments (not shown), the picture holder rotating block may comprise an upper picture holder support body and a lower picture holder support body, both of which preferably have a structure similar to that of the picture holder support body 402 of the embodiment shown in FIGS. 44 to 49. Preferably, the upper surface of the upper picture holder support body intersects the body of the hub at its upper end. The lower picture holder support body may taper linearly from its distal end to its proximal end such that its lower surface intersects the body 252 of the hub at the intersection of its tapered and cylindrical portions 252*a* and 252*b*, similar to gusset panels 414 of the embodiment shown in FIGS. 44 to 49. One or more side walls may extend between the perimeters of the upper and lower picture holder support bodies. In other embodiments (not shown), the picture holder rotating block may comprise a single picture holder support body that is thicker than, but otherwise has a structure similar to that of, the picture holder support body 402 of the embodiment shown in FIGS. 44 to 49. Preferably, the upper surface of the picture holder support body intersects the body of the hub at its upper end. The lower surface of the picture holder support body may taper linearly from its distal end to its proximal end such that it intersects the body 252 of the hub at the intersection of its tapered and cylindrical portions 252*a* and 252*b*, similar to gusset panels 414 of the embodiment shown in FIGS. 44 to 49. In embodiments using a thicker picture holder support body, the gusset panels may be omitted. Other variations in the size, shape, and configuration of the picture holder rotating block 400 are contemplated by the present invention.

FIGS. 51 to 55 show a fold-up toy support rotating block 500 in accordance with one embodiment of the present invention. The fold-up toy support rotating block 500 of this embodiment uses a hub 200 of the type shown in FIGS. 13 to 18, although other embodiments of the fold-up toy support rotating block 500 may use a hub of another design, such as a hub 250 of the type shown in FIGS. 19 to 22. A fold-up toy support body 502 emanates from the body 202 of the hub 200. The fold-up toy support body 502 may have a generally uniform thickness and a perimeter that is shaped so as to define a circle. Preferably, the upper and lower surfaces of the fold-up toy support body 502 are orthogonal to the axis of the hub 200. In the configuration shown in FIGS. 51 to 55, the fold-up toy support body 502 is relatively thin compared to the height of the body 202 of the hub 200, the upper surface of the fold-up toy support body 502 intersects the body 202 of the hub 200 at its upper end. A side wall 504 may extend downward from the perimeter of the fold-up toy support body 502. Preferably, the side wall 504 has a curvature that matches the circular perimeter of the fold-up toy support body 502. The lower edge of the side wall 504 may be shaped so as to define a plurality of teeth 514 of generally uniform height. In this configuration, the fold-up toy support body 502 and the teeth 514 of the side wall 504 form a structure resembling a crown gear. Gusset panels 506 may be formed along the lower surface of the fold-up toy support body 502 and may intersect the inner side surface of the teeth 504 of the side wall 504.

A plurality of slots 510 may be formed downward from the top surface of the fold-up toy support body 502 through at least a portion of its height, and optionally may extend downward through the entire height of the fold-up toy support body 502 and at least a portion of the height of a plurality of projections 508 formed on the lower surface the fold-up toy support body 502. The projections 508 are preferably in the shape of square or rectangular cuboids with semi-cylindrical ends, although other shapes and configurations may be used. In the configuration shown, a plurality of inner slots 510*a* are formed proximal to the hub 200, and a plurality of outer slots 510*b* are formed distal to the hub 200. The slots 510 may be configured to hold a portion of a fold-up toy or similar item. Ridges 512*a*, 512*b*, and 512*c*, which preferably are semi-cylindrical, may be formed vertically along the interior side surfaces defined by the slots 510*a* and 510*b* to further secure the fold-up toy in place within the slots 510*a* and 510*b*. The number, configuration, and location of the ridges 512*a*, 512*b*, and 512*c* may vary in different embodiments. Preferably, the lower edges of the side wall 504, and the lower surfaces of the projections 508, lie in one or more planes that intersect the body 202 of the hub 200 at a location above its lower end.

In some embodiments (not shown), the fold-up toy support rotating block may comprise an upper fold-up toy support body and a lower fold-up toy support body, both of which preferably have a structure similar to that of the fold-up toy support body 502 of the embodiment shown in FIGS. 51 to 55. Preferably, the upper surface of the upper fold-up toy support body intersects the body of the hub at its upper end, and the lower surface of the lower fold-up toy support body intersects the body of the hub at a location slightly above its lower end. A side wall, which preferably has a structure similar to that of the side wall 504 of the embodiment shown in FIGS. 51 to 55, may extend between the perimeter of the upper and lower fold-up toy support bodies. In other embodiments (not shown), the fold-up toy support rotating block may comprise a single fold-up toy support body that is thicker than, but otherwise has a structure similar to that of, the fold-up toy support body 502 of the embodiment shown in FIGS. 51 to 55. Preferably, the upper surface of the fold-up toy support body intersects the body of the hub at its upper end, and the lower surface of the fold-up toy support body intersects the body of the hub at a location slightly above its lower end. In embodiments using a thicker fold-up toy support body, the side wall and gusset panels may be omitted. Other variations in the size, shape, and configuration of the fold-up toy support rotating block 500 are contemplated by the present invention.

FIGS. 56 to 60 show a fold-up carousel toy 600 in accordance with one embodiment of the present invention. The carousel toy 600 is configured for coupling to the fold-up toy support rotating block 500 of FIGS. 51 to 55. The carousel toy 600 includes a fold-up base 602 having a plurality of upper tabs 604 extending upward from its upper end and a plurality of lower tabs 606 extending downward from its lower end, a fold-up ceiling 608 having a plurality of slots 610, and a plurality of horse-shaped seats 612 having a plurality of lower tabs 614 extending downward from their lower ends. The upper tabs 604 of the base 602 are configured to be received within the slots 610 in the ceiling 608. The lower tabs 606 of the base 602 are configured to be received within the inner slots 510*a* formed in the fold-up toy support rotating block 500. The lower tabs 614 of the horse-shaped seats 612 are configured to be received into the outer slots 510*b* formed in the fold-up toy support rotating block 500. The fold-up carousel toy 600 may be assembled and coupled to the fold-up toy support rotating block 500 in the manner shown in FIGS. 59 and 60.

Figure 61:
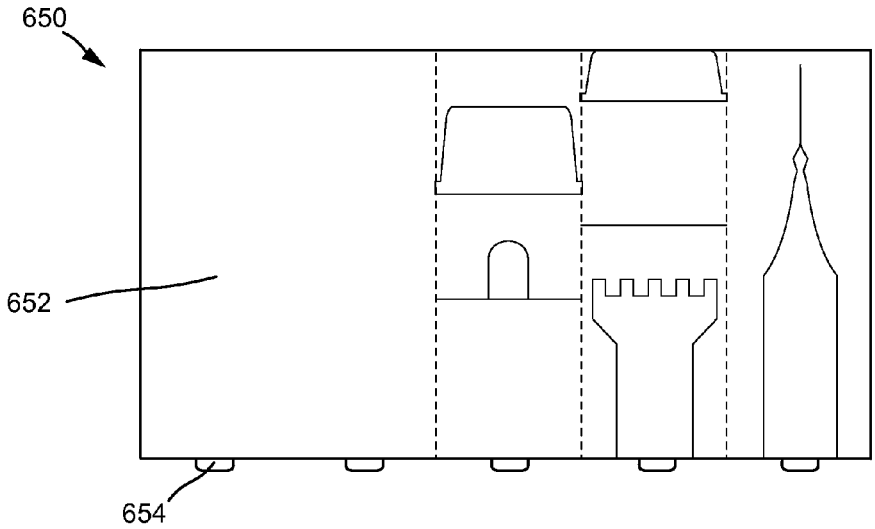
FIG. 61 is a top view of a fold-up castle toy in accordance with one embodiment of the present invention.
Figure 62:
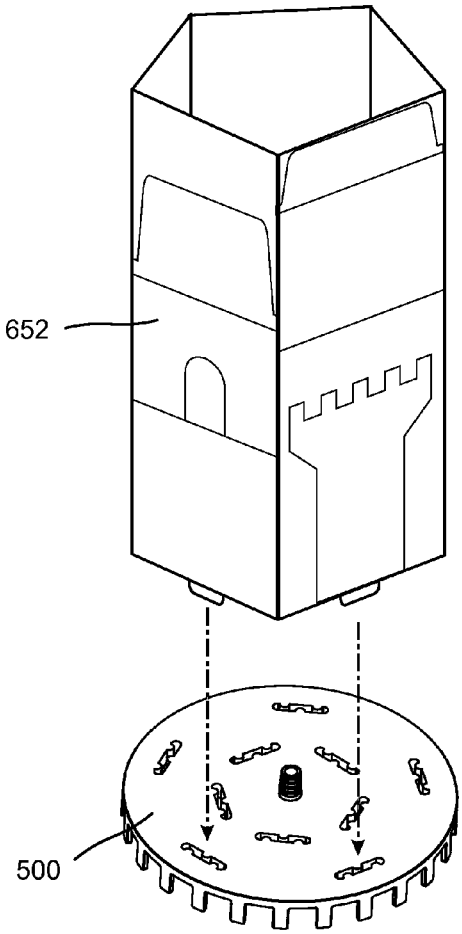
FIG. 62 is a perspective view showing the assembly of the fold-up castle toy of FIG. 61 with the fold-up toy support rotating block of FIG. 51.
Figure 63:
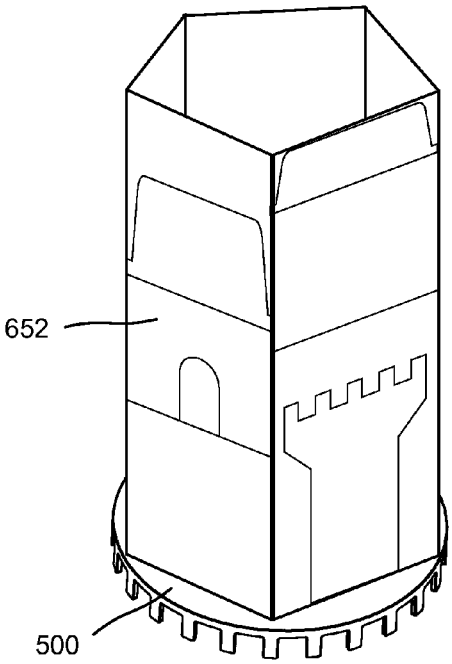
FIG. 63 is a perspective view showing an assembly of the fold-up castle toy of FIG. 61 with the fold-up toy support rotating block of FIG. 51

FIGS. 61 to 63 show a fold-up castle toy 650 in accordance with one embodiment of the present invention. Like the carousel toy 600 of FIGS. 56 to 60, the castle toy 650 is configured for coupling to the fold-up toy support rotating block 500 of FIGS. 51 to 55. The castle toy 650 comprises a fold-up base 652 having a plurality of lower tabs 654 extending downward from its lower end. The lower tabs 654 of the base 652 are configured to be received within the outer slots 510*b* formed in the fold-up toy support rotating block 500. The fold-up castle toy 650 may be assembled and coupled to the fold-up toy support rotating block 500 in the manner shown in FIGS. 62 and 63.

FIGS. 64 to 69 show a Geneva drive 700 in accordance with one embodiment of the present invention. The Geneva drive 700 comprises a drive wheel rotating block 702 and a driven wheel rotating block 750. Both the drive wheel rotating block 702 and a driven wheel rotating block 750 of this embodiment use a hub 200 of the type shown in FIGS. 13 to 18, although other embodiments of the spur gear rotating block may use a hub of another design, such as a hub 250 of the type shown in FIGS. 19 to 22. A drive wheel body 704 emanates from the body 202 of the first hub 200. The drive wheel body 704 may have a perimeter that is shaped so as to define a circle. The drive wheel body 704 may include a raised crescent-shaped blocking disc 706 and an upward-protruding pin 708. Preferably, the planar surfaces of the drive wheel body 704 are orthogonal to the axis of the hub 200. In the configuration shown in FIGS. 64 to 69, the upper surface of the blocking disc 706 intersects the body 202 of the hub 200 at its upper end. A side wall 710 having a generally uniform height may extend downward from the lower surface of the drive wheel body 704. The side wall 710 may have a curvature that defines a plurality of teeth 712, similar to the side wall of the spur gear rotating block 340 shown in FIGS. 39 to 43. Preferably, the lower edge of the side wall 710 lies in a plane that intersects the body 202 of the hub 200 at a location above its lower end.

Figure 64:
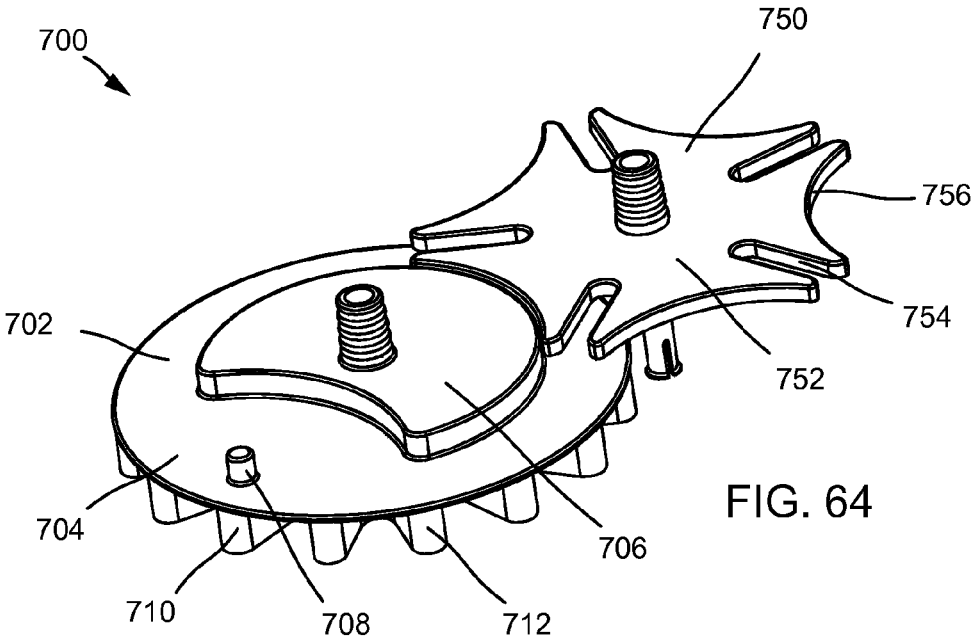
FIG. 64 is a perspective view showing upper surfaces of a drive wheel rotating block and a driven wheel rotating block of a Geneva drive in accordance with one embodiment of the present invention.
Figure 65:
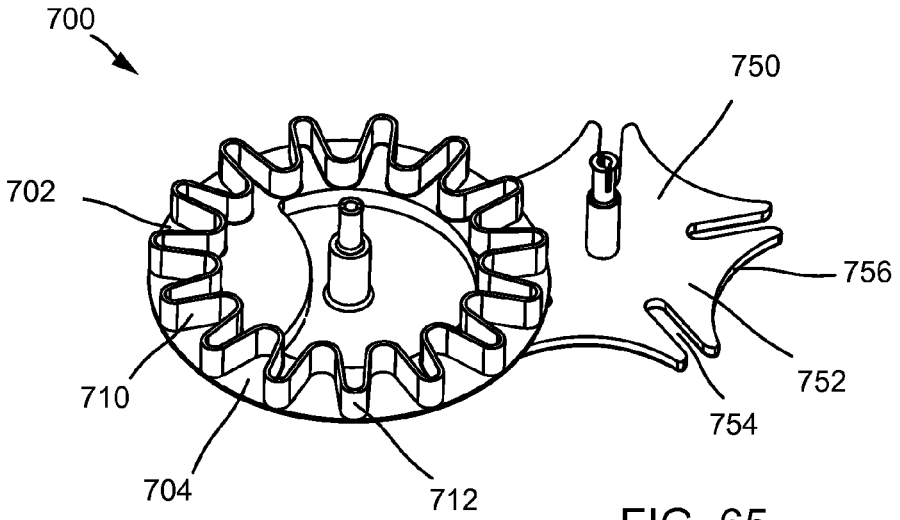
FIG. 65 is a perspective view showing lower surfaces of the drive wheel rotating block and the driven wheel rotating block of FIG. 64.
Figure 66:
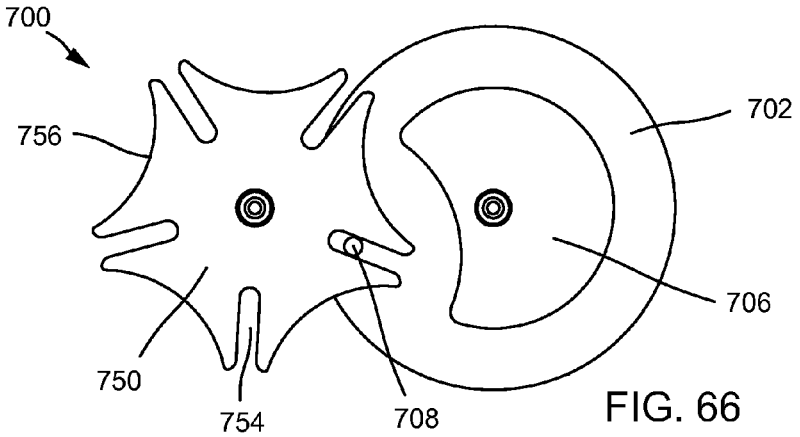
FIG. 66 is a top view showing the drive wheel rotating block and the driven wheel rotating block of FIG. 64.
Figure 67:
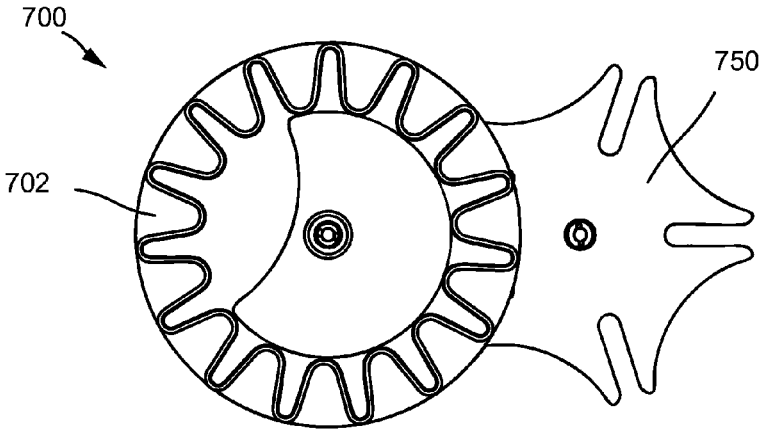
FIG. 67 is a bottom view showing the drive wheel rotating block and the driven wheel rotating block of FIG. 64.
Figure 68:
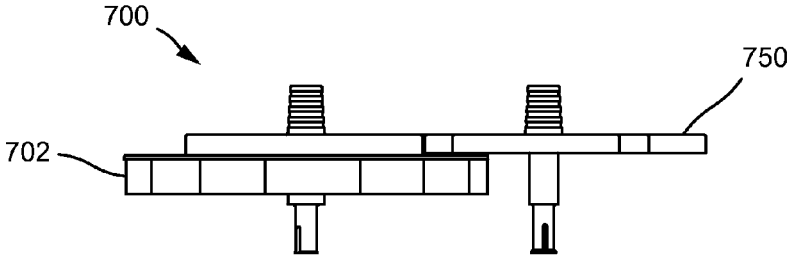
FIG. 68 is a front view showing the drive wheel rotating block and the driven wheel rotating block of FIG. 64.
Figure 69:
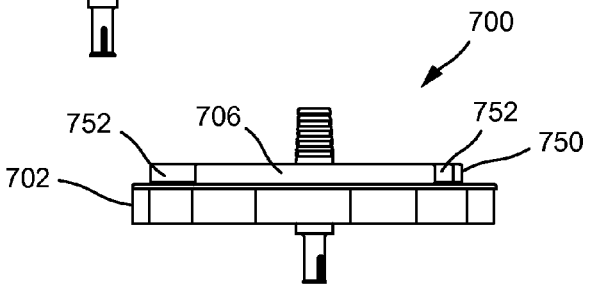
FIG. 69 is a side view showing the drive wheel rotating block and the driven wheel rotating block of FIG. 64.
Figure 70:
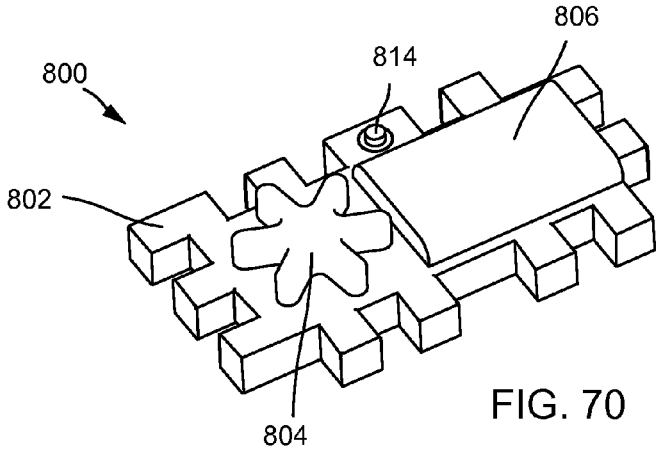
FIG. 70 is a perspective view showing a motorized base block in accordance with one embodiment of the present invention.
Figure 71:
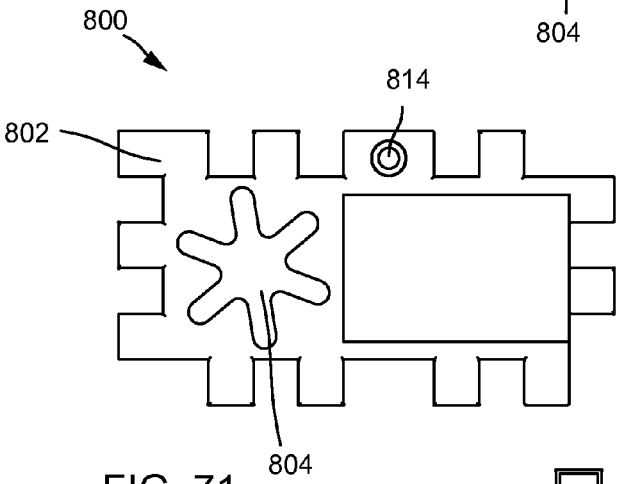
FIG. 71 is a top view of the motorized base block of FIG. 70.
Figure 72:
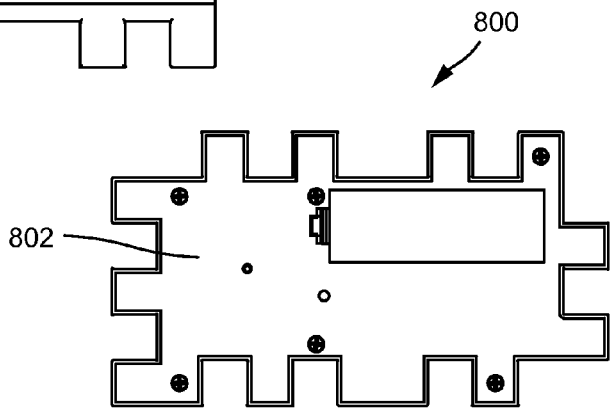
FIG. 72 is a bottom view of the motorized base block of FIG. 70.
Figure 73:
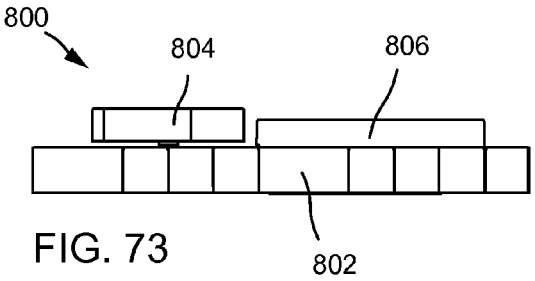
FIG. 73 is a side view of the motorized base block of FIG. 70.
Figure 74:
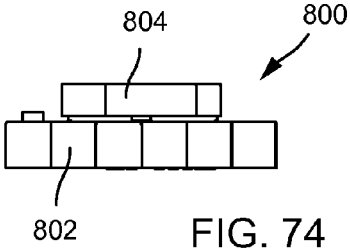
FIG. 74 is a front view of the motorized base block of FIG. 70.

A driven wheel body 752 emanates from the base 202 of the second hub 200. The driven wheel body 752 may have a generally uniform thickness and a perimeter that is shaped so as to define a regular polygon. Slots 754 may extend inward from each corner of the polygon towards the center of the driven wheel body 752 to accommodate the pin 708 of the drive wheel rotating block 702 (as shown in FIG. 66), and a curve 756 may be formed into each side of the polygon to accommodate the blocking disc 706 of the drive wheel rotating block 702 (as shown in FIG. 64). Preferably, the upper and lower surfaces of the driven wheel body 752 are orthogonal to the axis of the hub 200. In the configuration shown in FIGS. 64 to 69, the driven wheel body 752 is relatively thin compared to the height of the body 202 of the hub 200, and the upper surface of the driven wheel body 752 intersects the body 202 of the hub 200 at its upper end. The drive wheel rotating block 702 and the driven wheel rotating block 750 are preferably configured so that the lower surface of the driven wheel body 752 lies just above the upper surface of the drive wheel body 704 when the rotating blocks are coupled to one or more base blocks, such as base blocks 100 of the type shown in FIGS. 1 to 3.

In some embodiments (not shown), the drive wheel rotating block may comprise an upper drive wheel body and a lower drive wheel body. Preferably, the upper drive wheel body has a structure similar to that of the drive wheel body 704 of the embodiment shown in FIGS. 64 to 69, and the lower drive wheel body has a generally uniform thickness and a perimeter that is shaped so as to define a plurality of teeth, similar to the teeth 712 of the side wall 710 of the embodiment shown in FIGS. 64 to 69. Preferably, the upper surface of the blocking disc of the upper drive wheel body intersects the body of the hub at its upper end, and the lower surface of the lower drive wheel body intersects the body of the hub at a location slightly above its lower end. A side wall, which preferably has a structure similar to that of the side wall 710 of the embodiment shown in FIGS. 64 to 69, may extend between the lower surface of the upper drive wheel body and the perimeter of the lower drive wheel body in such a manner that the teeth of the side wall are aligned with the teeth of the lower drive wheel body. Alternatively, the lower drive wheel body may have a thickness approximately equal to the height of the side wall 710 of the embodiment shown in FIGS. 64 to 69, but may otherwise have a structure similar to that of the lower drive wheel body of the previously described embodiment. In this embodiment, the upper surface of the lower drive wheel body may be coupled to the lower surface of the upper drive wheel body, and the side wall and gusset panels may be omitted. Moreover, while the driven wheel rotating block 750 of the embodiment shown in FIGS. 64 to 69 comprises a driven wheel body 752 that is derived from a pentagonal structure (and therefore includes five slots 754 extending inward from each of its five corners), other embodiments (not shown) of the driven wheel rotating block may comprise a driven wheel body that is derived from a regular polygonal structure having a number of sides other than five (and therefore may include a number of slots other than five). Other variations in the size, shape, and configuration of the drive wheel rotating block 702 and the driven wheel block 750 are contemplated by the present invention.

Figure 75:
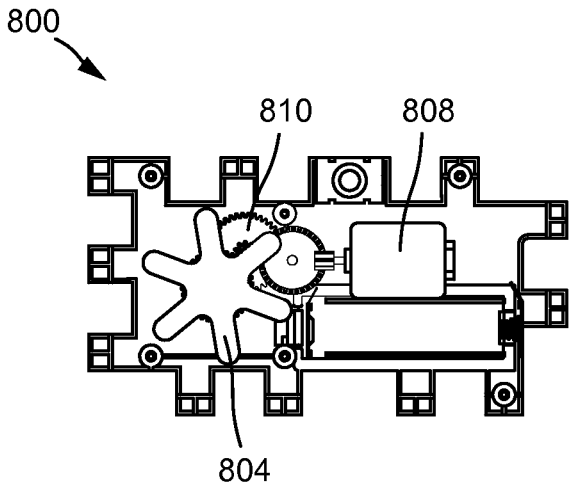
FIG. 75 is a top view of the motorized base block of FIG. 70 with the top cover removed.
Figure 76:
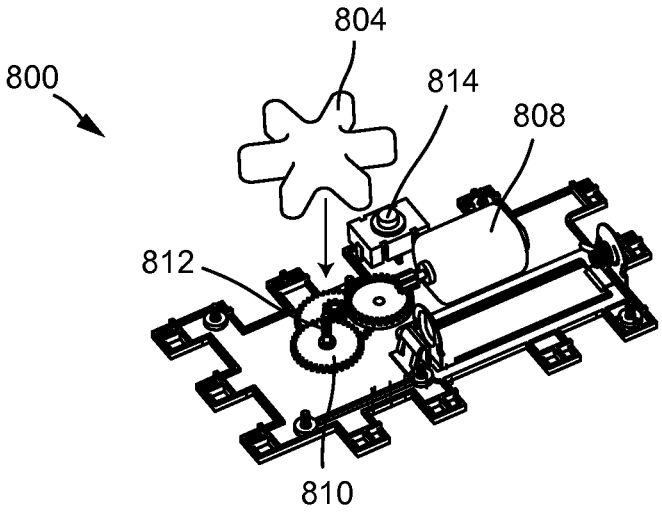
FIG. 76 is a perspective view of the motorized base block of FIG. 70 with the top cover removed.

FIGS. 70 to 76 show a motorized base block 800 in accordance with one embodiment of the present invention. The motorized base block 800 comprises a base 802 having an external gear 804 projecting upward therefrom. The base 802 of the motorized base block 800 is configured for coupling to base blocks 100 of the type shown in FIGS. 1 to 3. A raised portion 806 of the base 802 may be configured to accommodate a battery (not shown) and a motor 808. The motor 808 may be a standard DC motor, and may be configured to drive a gear train 810, as shown in FIGS. 75 and 76. An axle 812 may extend upward from one of the gears in the gear train 810 and through the base 802. The axle 812 may be configured for non-rotational coupling to the external gear 804. A push button 814 configured to actuate the motor 810 may be provided in the base 802. The motorized base block 800 can be used in an assembly of base blocks and rotating blocks to create powered rotational motion in the rotating blocks.

As used with respect to base blocks, the term "vertical" means in a direction orthogonal to the upper surface 102 and the lower surface 104. As used with respect to the hub and the rotating blocks, the term "vertical" means in a direction parallel to the axis of the hub 200 or 250. Directional and relational terms such as "vertical," "upper," "lower," "upward," and "downward," as used herein, are intended only to describe the locations and orientations of the various components and features of the invention relative to one another, and are not used in reference to any external coordinate system. Thus, the directional and relational terms used herein should not be construed as requiring that any of the components or features described herein should be positioned at any particular location, or in any particular orientation, with respect to any external frame of reference. Those skilled in the art will appreciate that the embodiments described herein are illustrative and not restrictive, and that modifications may occur depending upon design requirements without departing from the scope of the invention, as recited in the claims.

What is claimed is:

1. A toy construction set comprising a first base block and a second base block, wherein:

each of said base blocks is defined by:

an upper surface having a periphery defined by plurality of side edges;

a lower surface having a periphery defined by a plurality of side edges; and a plurality of side surfaces, each of said side surfaces having an upper edge that is coupled to a side edge of said upper surface, a pair of vertical edges each of which is coupled to a vertical edge of an adjacent side surface, and a lower edge that is coupled to a side edge of said lower surface;

each of said base blocks comprises:

a rectangular cuboid body; and a plurality of square cuboid-shaped projections, each of said square cuboid-shaped projections extending outward from a side of said body, and each pair of adjacent square cuboid-shaped projections being separated from each other by a cube-shaped recess;

each of said square cuboid-shaped projections is selected from the group consisting of:

a cube-shaped projection; and a square cuboid-shaped projection that is approximately twice the size of said cube-shaped projection;

said first base block includes a ridge that is formed along at least a portion of a length of an outermost vertical edge of a side surface of at least one of said square cuboid-shaped projections, said outermost vertical edge extending between said upper surface and said lower surface along a side surface that is coupled to said body, said outermost vertical edge being distal from said body;

said second base block includes a notch that is formed along at least a portion of a length of an innermost vertical edge of a side surface of at least one of said square cuboid-shaped projections, said innermost vertical edge extending between said upper surface and said lower surface along a side surface that is coupled to said body, said innermost vertical edge being proximal to said body; and said ridge of said first base block and said notch of said second base block are configured to engage with each other when said first base block and said second base block are coupled to each other in a planar configuration.

2. The toy construction set of claim 1 wherein:

said second base block includes an upper radius or an upper chamfer that is formed on at least a portion of at least one of said square cuboid-shaped projections, said upper radius or said upper chamfer connecting at least a portion of one of said upper edges of one of said side surfaces to at least a portion one of said side edges of said upper surface; and said ridge of said first base block and said upper radius or said upper chamfer of said second base block are configured to engage with each other when said first base block and said second base block are coupled to each other in a first orthogonal configuration.

3. The toy construction set of claim 2 wherein:

said second base blocks includes a lower radius or a lower chamfer that is formed on at least a portion of at least one of said square cuboid-shaped projections, said lower radius or said lower chamfer connecting at least a portion of one of said lower edges of one of said side surfaces to at least a portion one of said side edges of said lower surface;

said ridge of said first base block and said lower radius or said lower chamfer of said second base block are configured to engage with each other when said first base block and said second base block are coupled to each other in a second orthogonal configuration.

4. The toy construction set of claim 1 further comprising:

an interior cylindrical surface extending through said body between said upper surface and said lower surface;

an upper circular chamfer connecting said interior cylindrical surface to said upper surface; and a lower circular chamfer connecting said interior cylindrical surface to said lower surface.

5. A base block for use in a toy construction set comprising a rectangular cuboid body and a plurality of square cuboid-shaped projections, each of said square cuboid-shaped projections extending outward from a side of said body, and each pair of adjacent square cuboid-shaped projections being separated from each other by a cube-shaped recess, wherein:

each of said square cuboid-shaped projections is selected from the group consisting of:

a cube-shaped projection; and a square cuboid-shaped projection that is approximately twice the size of said cube-shaped projection;

said base block is formed from:

an upper base block portion comprising:

an upper wall defined by an upper surface, a lower surface, and a plurality of side edges;

a plurality of side walls, each of said side walls being defined by an outer surface, an inner surface, an upper edge that is coupled to a side edge of said upper wall, a pair of vertical edges each of which is coupled to a vertical edge of an adjacent side wall, and a lower edge; and an upper column portion extending downward from said lower surface of said upper wall of said upper base block portion; and a lower base block portion comprising:

a lower wall defined by an upper surface, a lower surface, and a plurality of side edges; and a lower column portion extending upward from said upper surface of said lower wall of said lower base block portion;

said upper base block portion and said lower base block portion are configured to be coupled to each other such that said lower surface of said upper wall faces said upper surface of said lower wall, said lower surface of said lower wall is flush with said lower edges of said side walls, and said side edges of said lower wall are flush against said inner surfaces of said side walls;

said upper column portion and said lower column portion are configured to mesh with each other to form a hollow cylindrical column having an outer surface and an inner surface, said outer surface of said hollow cylindrical column extending between said upper surface of said lower wall and said lower surface of said upper wall when said upper base block portion and said lower base block portion are coupled to each other, and said inner surface of said hollow cylindrical column defining an interior cylindrical surface extending between said upper and lower surfaces of said base block; and said base block is defined by:

said upper surface of said upper wall;

said lower surface of said lower wall; and said outer surfaces of said side walls.

6. The base block of claim 5 wherein said upper base block portion further comprises a plurality of partition walls, each of said partition walls extending downward from said lower surface of said upper wall of said upper base block portion and terminating at a lower edge, wherein:

said lower edge of each of said partition walls is flush with said upper surface of said lower base block portion when said upper base block portion and said lower base block portion are coupled to each other; and each of said partition walls defines a boundary between said body and one of said square cuboid-shaped projections of said base block.

7. The base block of claim 5 wherein a chamfer connects said upper surface of said lower wall and said side edges of said lower wall.

8. The base block of claim 5 wherein said upper column portion and said lower column portion form a slip joint when said upper base block portion and said lower base block portion are coupled to each other.

9. The base block of claim 8 wherein:

said upper column portion has an outer surface having a uniform diameter, an upper inner surface having a uniform diameter, a lower inner surface having a uniform diameter, a ledge extending between said upper and lower inner surfaces of said upper column portion, and a terminal lower edge, said diameter of said upper inner surface of said upper column portion being greater than said diameter of said lower inner surface of said upper column portion;

said lower column portion has an inner surface having a uniform diameter, an upper outer surface having a uniform diameter, a lower outer surface having a uniform diameter, a ledge extending between said upper and lower outer surfaces of said lower column portion, and a terminal upper edge, said diameter of said upper outer surface of said lower column portion being less than said diameter of said lower outer surface of said lower column portion;

said diameter of said upper inner surface of said upper column portion is approximately equal to said diameter of said inner surface of said lower column portion, and said diameter of said outer surface of said upper column portion is approximately equal to said diameter of said lower outer surface of said lower column portion; and said lower inner surface of said upper column portion is flush against said upper outer surface of said lower column portion, said ledge of said upper column portion is flush against said terminal upper edge of said lower column portion, and said lower terminal edge of said upper column portion is flush against said ledge of said lower column portion when said upper base block portion and said lower base block portion are coupled to each other.

10. The base block of claim 8 wherein:

said upper column portion has an inner surface having a uniform diameter, an upper outer surface having a uniform diameter, a lower outer surface having a uniform diameter, a ledge extending between said upper and lower outer surfaces of said lower column portion, and a terminal lower edge, said diameter of said upper outer surface of said lower column portion being greater than said diameter of said lower outer surface of said lower column portion;

said lower column portion has an outer surface having a uniform diameter, an upper inner surface having a uniform diameter, a lower inner surface having a uniform diameter, a ledge extending between said upper and lower inner surfaces of said upper column portion, and a terminal upper edge, said diameter of said upper inner surface of said upper column portion being less than said diameter of said lower inner surface of said upper column portion;

said diameter of said inner surface of said upper column portion is approximately equal to said diameter of said lower inner surface of said lower column portion, and said diameter of said upper outer surface of said upper column portion is approximately equal to said diameter of said outer surface of said lower column portion; and said lower outer surface of said upper column portion is flush against said upper inner surface of said lower column portion, said ledge of said upper column portion is flush against said terminal upper edge of said lower column portion, and said lower terminal edge of said upper column portion is flush against said ledge of said lower column portion when said upper base block portion and said lower base block portion are coupled to each other.

11. The base block of claim 5 further comprising:

an upper circular chamfer connecting said interior cylindrical surface to said upper surface of said base block; and a lower circular chamfer connecting said interior cylindrical surface to said lower surface of said base block.

* * * * *